US009316453B2

(12) United States Patent
Seeley et al.

(10) Patent No.: US 9,316,453 B2
(45) Date of Patent: Apr. 19, 2016

(54) LAST ROUND LINK FEED SYSTEM

(71) Applicant: THE BETA COMPANY, Tucker, GA (US)

(72) Inventors: Hugh Kenton Seeley, Stone Mountain, GA (US); Silvia Kaiser-Block, Tucker, GA (US); John Braden, Monticello, GA (US); Lloyd McGarrett Stills, McDonough, GA (US)

(73) Assignee: THE BETA COMPANY, Tucker, GA (US)

( * ) Notice: Subject to any disclaimer, the term of this patent is extended or adjusted under 35 U.S.C. 154(b) by 0 days.

(21) Appl. No.: 14/474,704

(22) Filed: Sep. 2, 2014

(65) Prior Publication Data

US 2015/0090106 A1 Apr. 2, 2015

Related U.S. Application Data

(62) Division of application No. 13/416,960, filed on Mar. 9, 2012, now Pat. No. 8,839,707.

(60) Provisional application No. 61/450,951, filed on Mar. 9, 2011.

(51) Int. Cl.

| | |
|---|---|
| ***F41A 9/70*** | (2006.01) |
| ***F41A 9/71*** | (2006.01) |
| ***F41A 11/02*** | (2006.01) |
| ***F41A 9/64*** | (2006.01) |
| ***F41A 9/68*** | (2006.01) |
| ***F41A 9/26*** | (2006.01) |
| ***F41A 9/75*** | (2006.01) |

(52) U.S. Cl.

CPC ... *F41A 9/71* (2013.01); *F41A 9/26* (2013.01); *F41A 9/64* (2013.01); *F41A 9/68* (2013.01); *F41A 9/70* (2013.01); *F41A 9/75* (2013.01); *F41A 11/02* (2013.01); *Y10T 29/49826* (2015.01)

(58) Field of Classification Search

CPC ..... F41A 9/73; F41A 9/65; F41A 9/69; F41A 9/70; F41A 9/26; F41A 9/75; F41A 9/71; F41A 11/02; F41A 9/64; F41A 9/68

USPC ..... 89/33.02, 33.14, 33.16, 33.2, 33.25

See application file for complete search history.

(56) References Cited

U.S. PATENT DOCUMENTS

| | | | | |
|---|---|---|---|---|
| 3,672,089 | A * | 6/1972 | Silsby | 42/50 |
| 4,336,742 | A * | 6/1982 | Bourlet | 89/34 |
| 2011/0107901 | A1* | 5/2011 | Lasichak et al. | 89/33.02 |

FOREIGN PATENT DOCUMENTS

| | | | |
|---|---|---|---|
| GB | 615471 | * | 1/1949 |

*Primary Examiner* — Stephen M Johnson

(74) *Attorney, Agent, or Firm* — Gronholm Patent Services, LLC

(57) ABSTRACT

A modified elongate ammunition magazine, the magazine being modified by modifying an elongate, single plane magazine by removing its end cap so as to provide an elongate modified magazine having an upper end for attaching to said magazine well of a firearm, a lower end, and a through passageway therebetween, and a clip leg base attached thereto and also attachable to a high capacity ammunition magazine housing, the clip leg base configured such that when it is attached to said modified magazine to construct a feed clip assembly, and when the clip leg base is also attached to a high capacity magazine, and when the upper end of the modified magazine is installed into a firearm, an ammunition passageway is defined from an ammunition outlet of a high capacity ammunition magazine housing, through the modified magazine, and to a firearm. Also provided is a last linked assembly including a loose or spreadable link.

11 Claims, 33 Drawing Sheets

Fig. 1 ASSEMBLED MAGAZINE 5 (Includes Magazine Adaptor Assembly 10 and Feed Mechanism 7)
Cal: 9 x 19 mm
Firearm: Uzi (standard)
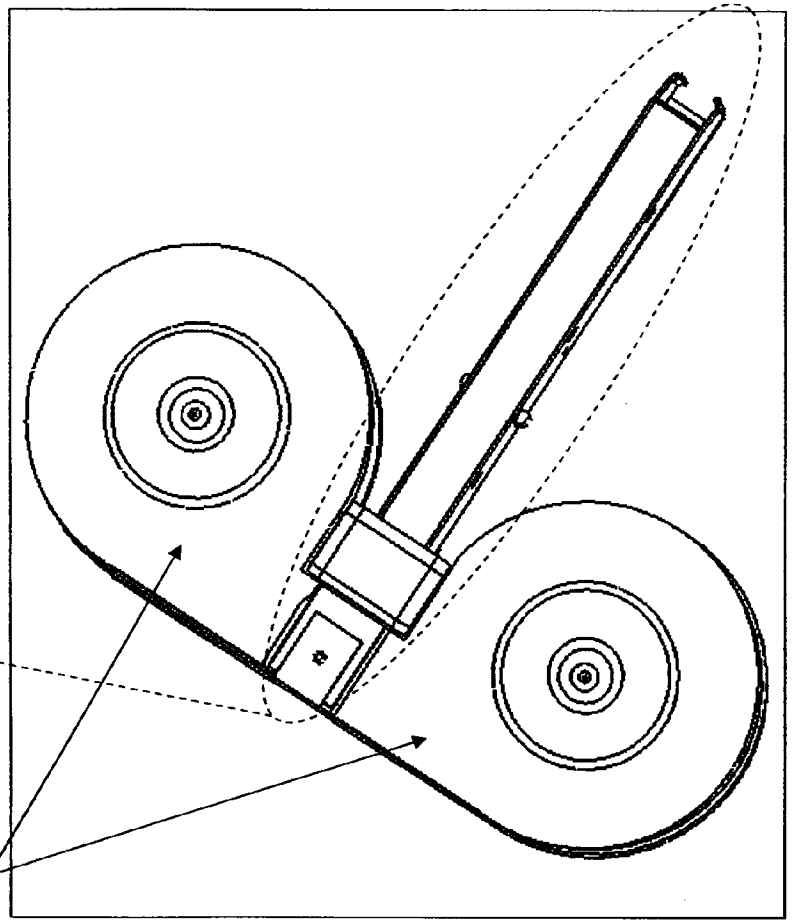

Fig. 2 ASSEMBLED MAGAZINE 5 WITH SINGLE PIECE MOLDED FEED TUBE
Cal: 5.56 NATO
Firearm: M16/M4/AR15
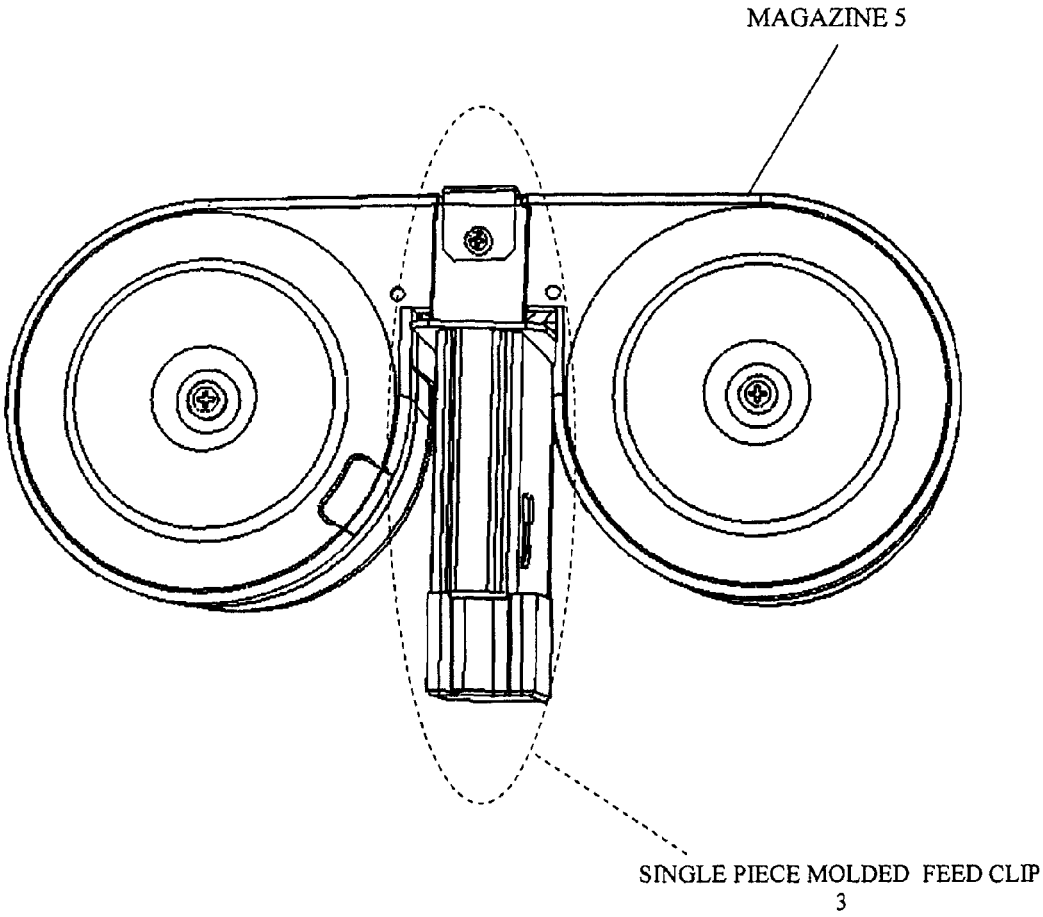

Fig. 3 SINGLE PIECE MOLDED FEED CLIP 3 SHOWN REMOVED
Cal: 5.56 NATO
Firearm: M16/M4/AR15
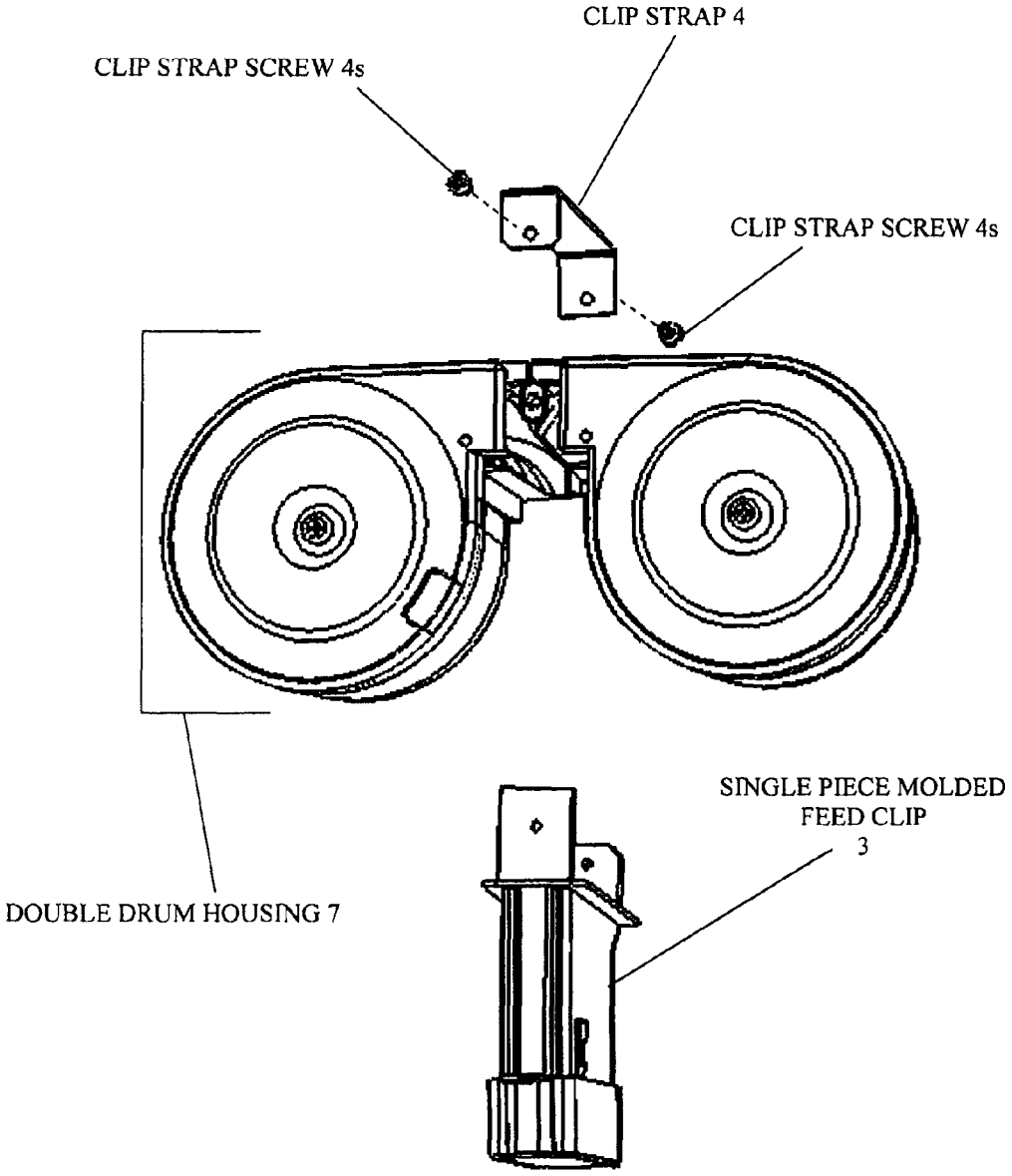

Fig. 4 MOLDED FEED CLIP 3 SHOWN DISCONNECTED
Cal: 5.56 NATO
Firearm: M16/M4/AR15
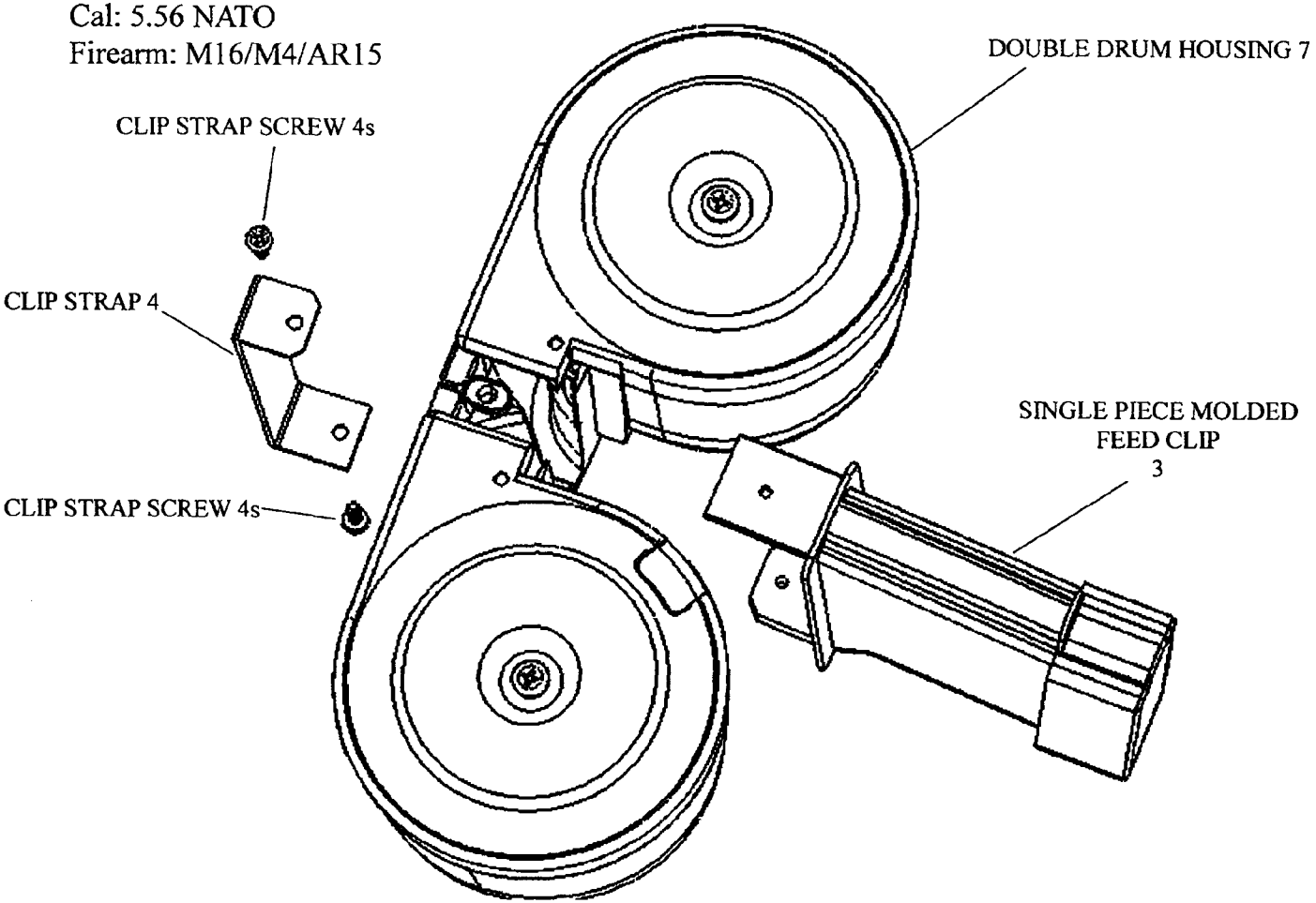

Cal: 9X19mm
Firearm: Uzi

Cal: 9X19mm
Firearm: Uzi

Cal: 9X19mm
Firearm: Uzi

Cal: 9x19mm
Firearm: Uzi

Cal: 9x19mm
Firearm: Uzi

Cal: 9x19mm
Firearm: Uzi

Cal: 9x19mm
Firearm: Uzi

Cal: 9x19mm
Firearm: Uzi

Cal: 9X19mm

Cal: 9X19mm

Cal: 9x19mm

Cal: 9X19mm

Cal: 9X19mm

Cal: 9X19mm

Cal: 9X19mm

Cal: 9X19mm

Cal: 9X19mm

Cal: 7.62X51mm
Firearm: HK G3

Cal: 7.62X51mm
Firearm: HK G3

Cal: 7.62X51mm
Firearm: M-14

NOTE-CLIP LEG COVER IS NOT SHOWN

Cal: 7.62X51mm
Firearm: M-14

Cal: 7.62X51mm
Firearm: M-14

Cal: 7.62X51mm

Cal: 7.62X51mm

Cal: 7.62X51mm

Cal: 7.62X51mm

Cal: 7.62X51mm
Firearm: M-14

Cal: 7.62X51mm

Cal: 7.62X51mm

Cal: 7.62X51mm

UNMODIFIED 33 ROUND
GLOCK 9MM MAGAZINE 205

UPPER END DETAIL
(EMPTY)

UPPER END
CUTAWAY
(CHARGED)

Caliber: 9mm

Caliber: 9mm

Caliber: 9mm

Caliber: 9mm

Linked assembly 270 Shown Here Beneath Feed Clip Lip

Cal: 9mm

Caliber: 9 mm

Caliber: 9 mm

Caliber: 9 mm

Link and dummy cartridge configurations

Caliber: 9 mm

Glock last round linked assembly 210

Glock last round linked assembly 210

Caliber: . 338 Lapua

LAST ROUND LINK FEED SYSTEM

CROSS-REFERENCE TO RELATED APPLICATIONS

This application claims the full benefit and priority of nonprovisional application Ser. No. 13/416,960, filed Mar. 9, 2012, entitled Magazine Adaptor System, now U.S. Pat. No. 8,839,707, which itself claims priority from provisional patent application No. 61/450,951, filed Mar. 9, 2011, entitled "Magazine Adaptor System". The entire contents of both of said applications are incorporated herein by reference.

BACKGROUND OF THE INVENTION

U.S. Pat. No. 4,658,700 is referenced and incorporated by reference.

SUMMARY OF THE INVENTION

The general concept relates to magazines for firearms, and particularly relates to the use of a last linked assembly including a loose or spreadable link.

Some of the earlier work in this technical space includes the provision of a "Beta C-Mag" high capacity ammunition magazine developed by The Beta Company.

The present invention presents an improvement to prior developed technology by providing a system that includes the use of a new "clip leg base", that facilitates the conversion of a firearm magazine into a feed tube subcomponent of a feed clip assembly for use with one double drum housing of a Beta C-MAG or other high capacity magazine.

Use of such a new feed clip assembly with a double drum housing of a Beta C-MAG magazine (which stores and feeds such ammo), along with other feed clip assemblies, one assembly per firearm, facilitates the use of the same Beta C-MAG double drum housing for multiple firearms of the same caliber.

Generally described, one invention relates to a clip leg base for use within a feed clip assembly for use with a high capacity ammunition magazine housing having an ammunition outlet, the clip leg base also for use with a firearm having a magazine well, the clip leg base itself comprising: A) a body defining a cavity, the body configured for accepting and attaching to the lower end of a modified elongate ammunition magazine, the magazine being modified by modifying an elongate, single plane magazine by removing its end cap so as to provide an elongate modified magazine having an upper end for attaching to the magazine well of the firearm, a lower end, and a through passageway therebetween; and B) at least one clip leg for attaching the clip leg base to the high capacity ammunition magazine housing, the clip leg base configured such that when it is attached to the modified magazine to construct the feed clip assembly, and when the clip leg base is also attached to the high capacity magazine, and when the upper end of the modified magazine is installed into the firearm, an ammunition passageway is defined from the ammunition outlet of the high capacity ammunition magazine housing, through the modified magazine, and to the firearm.

Further inventions relating to the above paragraph include the clip leg base body including a through hole configured to allow passage of ammunition therethrough, such that ammunition passes through said through hole prior to passing through said through passageway of said modified elongate magazine, as well as the use of two clip legs.

Another invention relates to a method of constructing a feed clip assembly for use with a firearm having a magazine well, and for use with a high capacity ammunition magazine housing having an ammunition outlet, the method including the steps of: A) providing an elongate modified magazine by modifying an elongate, single plane magazine by removing its end cap so as to having an upper end and a lower end and a through passageway therebetween, the upper end of the configured to attach to and feed ammunition to the magazine well of the firearm, and the lower end of the for receiving ammunition from an external source; B) attaching at least one engagement bracket proximate the lower end of the modified magazine; C) providing a clip leg base, the clip leg base configured to attach to the high capacity magazine; and D) attaching the clip leg base to the engagement bracket of the modified magazine, such that the feed clip assembly defines an ammunition passageway from the lower end of the modified magazine to the upper end of the modified magazine, the ammunition passageway of the feed clip assembly configured to provide an ammunition supply conduit between the ammunition outlet of the high capacity ammunition magazine and the firearm when the feed clip assembly is attached therebetween the high capacity ammunition magazine and the firearm.

Another invention relates to a feed clip assembly for use with a firearm having a magazine well, and for use with a high capacity ammunition magazine housing having an ammunition outlet, the feed clip assembly comprising the following components: A) an elongate modified magazine provided by modifying an elongate, single plane magazine by removing its end cap so as to provide an elongate modified magazine having an upper end and a lower end and a through passageway therebetween, the upper end of the elongate modified magazine configured to attach to and feed ammunition to the magazine well of a firearm, and the lower end for receiving ammunition from an external source; B) at least one engagement bracket attached to the modified magazine proximate the lower end of the modified magazine; C) a clip leg base, the clip leg base configured to attach to the high capacity magazine; and D) an attachment between the clip leg base and the engagement bracket of the modified magazine, such that the feed clip assembly defines a feed clip assembly ammunition feed passageway including the through passageway of the modified magazine, the components of the feed clip assembly assembled such that when the feed clip assembly is installed on the high capacity ammunition magazine housing, the feed clip assembly ammunition feed passageway provides ammunition communication between the ammunition outlet of the high capacity ammunition magazine housing and the magazine well of the firearm.

Another invention relates to a method of using multiple feed clip assemblies for use with multiple firearms but with a single particular high capacity ammunition magazine housing having an ammunition outlet, the method comprising the steps of: A) obtaining a first elongate magazine for use with a first firearm; B) obtaining a second elongate magazine for use with a second firearm, the first and second firearms configured to fire the same ammunition but having different elongate magazine configurations such that the elongate magazine configurations are not interchangeable between the first and second firearms; C) modifying both the first and second elongate magazines by removing their lower ends caps so as to create corresponding first and second modified magazines each having an upper end and a lower end and a through passageway therebetween; and D) attaching a clip leg base to each of the first and second elongate magazines, so as to provide corresponding first and second feed clip assemblies, with each the clip leg base within each of the first and second feed clip assemblies being configured to attach to the single particular high capacity ammunition magazine housing having an ammunition outlet, such that the first and second feed clip assemblies may be used in an interchangeable manner with the particular high capacity ammunition magazine.

Another invention relates to a last linked assembly and clear spacer cartridge combination for use with a firearm using a firearm having a magazine well, and for use with a high capacity ammunition magazine housing having an ammunition outlet, and for use with a feed clip assembly having a double stack portion tapering to a single stack exit location, the last linked assembly and clear spacer cartridge combination comprising the following components: A) a first dummy cartridge; B) a second dummy cartridge; C) a "loose" link for holding the first and second dummy cartridges together, the first and second dummy cartridge and the link comprising the last linked assembly; and D) a clear spacer cartridge configured to move along with the first and second dummy cartridges in a double stacked configuration through the double stack portion of the feed clip assembly, and configured to spread apart the first and second dummy cartridges within the tolerances of the "loose" link, to allow the last linked assembly to compress into the narrower channel caused by the taper of the feed clip assembly and push the last live round up to be chambered.

Other inventions relate to the claims as originally filed in this nonprovisional application.

BRIEF DESCRIPTION OF THE DRAWINGS

FIG. 1 is a pictorial view of an assembled 100 round magazine configured to be used with an UZI submachine gun or carbine.

FIG. 2 is a view of a prior art assembled 5.56 NATO 100 round magazine such as provided by The Beta Company.

FIG. 3 is a view of the magazine of FIG. 2, expect in a more disassembled view.

FIG. 4 is another view of that shown in FIG. 3.

DETAILED DISCUSSION

Figure 5A:
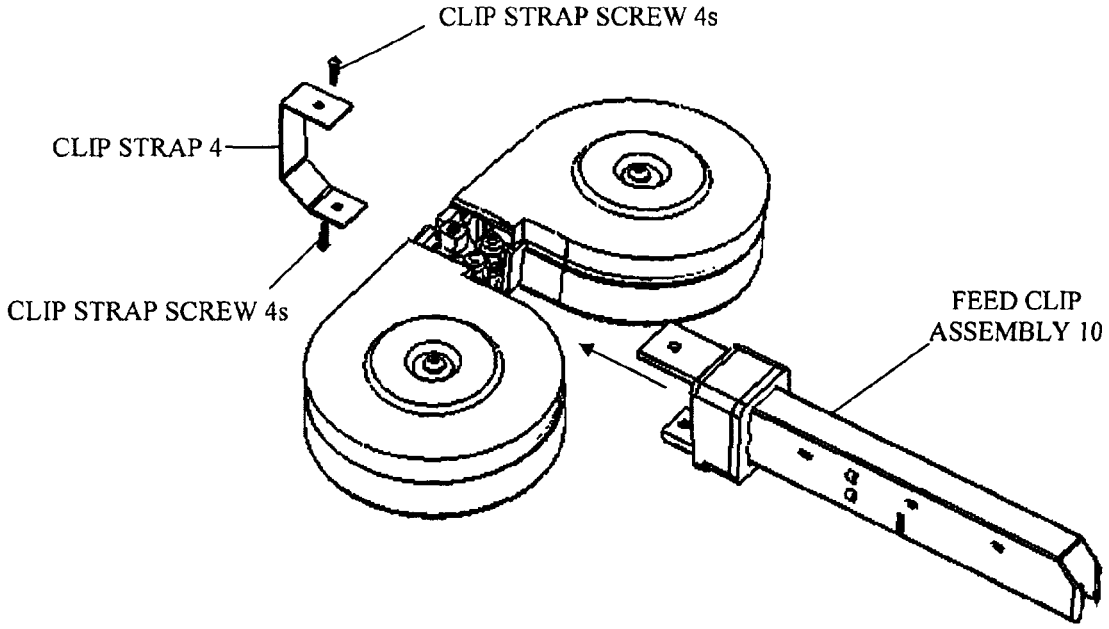
FIG. 5A shows a feed clip assembly 10 according to the present invention being installed.
Figure 5B:
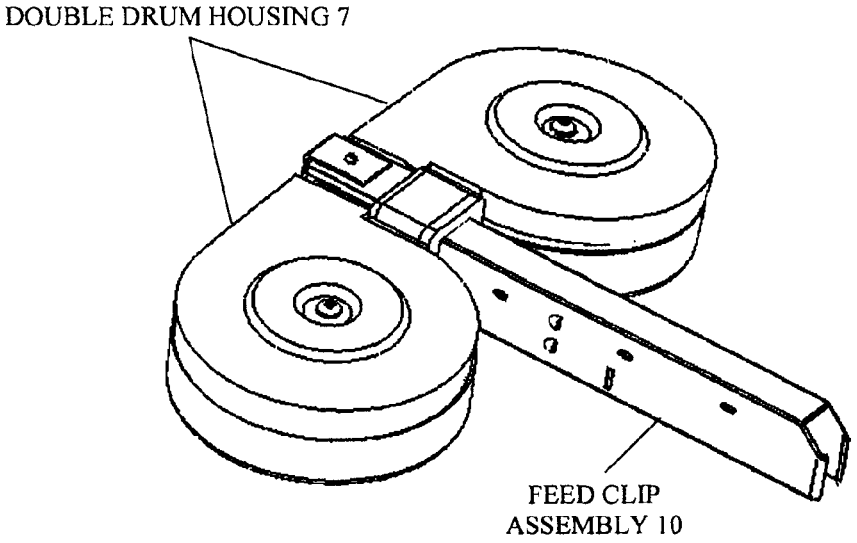
FIG. 5B shows an installed feed clip assembly 10 according to the present invention.

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Here follows both a general and detailed discussion of the inventive concepts.

I. GENERAL

The invention generally is directed towards the use of a new "clip leg base", that facilitates the conversion of a firearm magazine into a feed tube subcomponent of a feed clip assembly for use with one double drum housing of a Beta C-MAG or other high capacity magazine. Use of such a new feed clip assembly with a particular double drum housing of a Beta C-MAG magazine, along with other feed clip assemblies, facilitates the use of the same Beta C-MAG double drum housing for multiple firearms of the same caliber.

II. ELEMENTS LIST

The elements of the invention include the following:

9 mm Parts:

2 Prior Art Assembled Magazine
- 3 Single piece molded feed clip (equivalent to item 14 in '700 patent)
  - 4 Clip Strap
- 4*s* Clip Strap Screws

5 Assembled magazine

7 Double Drum Housing (equivalent to items 12 and 13 in '700 patent)
- 10 Feed Clip Assembly
- 20 Modified Magazine
  - 22 Elongate body
  - 24 Upper End
  - 26 Lower Open End (end cap removed during modification)
  - 28 Locking Tabs
- 30 Flanged Brackets
  - 36 Flow Engagement Holes
- 40 Epoxy/Adhesive
- 50 Clip Leg Cover
  - 52 Clearance Gaps
- 60 Clip Leg Base
  - 61 Body
  - 62 Long Clip Leg
  - 63 Short Clip Leg
  - 64 Adhesive Engagement Holes
  - 65 Location shelf
  - 67 Threaded Insert
  - 68 Stops
  - 69 Ammunition Exit Hole 7.62 Parts:

110 Feed Clip Assembly

120 Modified Magazine

130 Brackets

140 Epoxy/Adhesive

150 Clip Leg Cover (including parts 150A and 150B)

160 Clip Leg Base
- 161 Body
- 165 Location shelf

Glock Pistol Related Elements:

205 Unmodified Glock 9 mm magazine (for a Glock 17?)

210 Glock Feed Clip Assembly

250 Clear Spacer Round
- 252 Front section

270 Linked assembly
- 272 Loose (aka "spreadable") Link
- 274 Conventional Dummy Cartridges (aka dummy rounds, spacer rounds)

III. GENERAL CONSTRUCTION AND OPERATION

Generally described, the present invention provides a system that includes the use of a new "clip leg base", that facilitates the conversion of a firearm magazine into a feed tube subcomponent of a feed clip assembly for use with a particular double drum housing of a Beta C-MAG or other high capacity magazine. Use of such a new feed clip assembly with a particular double drum housing of a Beta C-MAG magazine, along with other feed clip assemblies facilitates the use of the same Beta C-MAG double drum housing for multiple firearms of the same caliber.

Construction is generally as follows, in reference generally to the figures. An existing, "off the shelf", "straight" ammunition magazine (or for that matter any pre-made magazine including custom magazines) is obtained and modified to accept ammunition fed into a hole in its lower end. A "straight" magazine is intended to be interpreted as facilitating substantially straight delivery of the cartridges within at least one "common plane". Thus slightly curved banana clips would be included. This lower end is also adapted via the use of two flanged brackets, a clip leg cover, and adhesive, such that the lower end attaches to a double drum housing such as that manufactured by The Beta Company. The modified magazine 20, brackets 30, adhesive 40, clip leg cover 50, and clip leg base 60 comprise a feed clip assembly 10. As noted above, users can use a particular double drum housing 7 of a Beta C-MAG magazine unit with multiple such feed clip assemblies 10, one assembly 10 per firearm, to facilitate the use of the same Beta C-MAG magazine double drum housing 7 for multiple firearms of the same caliber.

IV. MORE DETAILS OF CONSTRUCTION AND OPERATION

Here follow more details of construction and operation.

It is contemplated that for a given ammunition caliber, users can use a particular double drum housing of a Beta C-MAG magazine unit (which stores and feeds such ammo) with multiple feed clip assemblies, one assembly per firearm, to facilitate the use of the same Beta C-MAG magazine double drum housing for multiple firearms of the same caliber; at least one of these assemblies can include the use of a clip leg base according to one embodiment of the present invention.

FIGS. 1, 3-15 show 9 mm configurations.

FIGS. 16-24 show 7.62 configurations.

Reference is now generally made to the relevant figures.

Feed Clip Assembly 10

Each feed clip assembly 10 includes the following sub elements:

Modified magazine 20

Two Flanged Brackets 30

Epoxy/Adhesive 40

Clip Leg Cover 50

Clip Leg Base 60

The upper end of a feed clip assembly 10 is inserted into and engages within the downwardly-directed magazine cavity, or "magazine well", of a firearm in the same manner as a conventional "straight" magazine. The lower end of the feed clip assembly 10 is attached to a particular double drum housing 7 of a Beta C-MAG magazine unit as noted in more detail below.

Modified Magazine 20

A modified UZI 9 mm magazine 20 is shown in, for example, FIGS. 6 and 7A-7C. Modification of a complete, ready-to-use magazine consists of removal of all interior elements such as springs, guides, followers, etc, leaving a single piece sleeve of metal having an attached heel plate. This sleeve/plate subcomponent is then modified by removal of the base (aka bottom or heel) plate, essentially leaving a single piece sleeve of metal.

Said another way modification is performed on an elongate, single plane magazine by removing its end cap so as to provide an elongate modified magazine having an upper end for attaching to the magazine well of a firearm and a lower end and a through passageway therebetween.

However, it may also be understood that the sleeve/plate subcomponent could be obtained on its own (in order to reduce waste) prior to its modification.

It should specifically be understood that the make or model of such magazines is not critical to or in any way limits the invention.

Flanged Brackets 30

Figure 6:
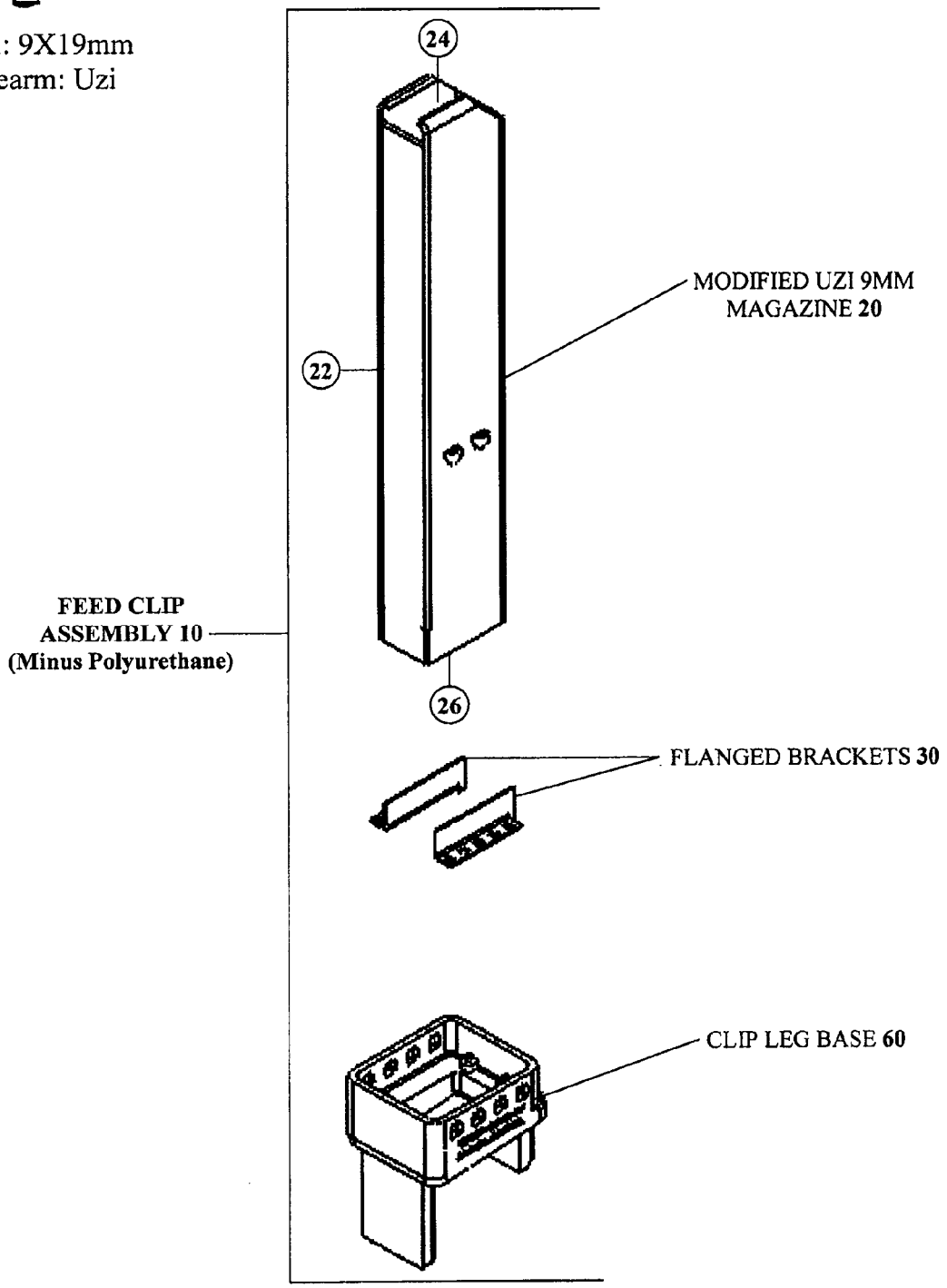
FIG. 6 shows a feed clip assembly 10 according to the present invention in a disassembled view. Note that adhesive is not shown in the view.
Figure 7C:
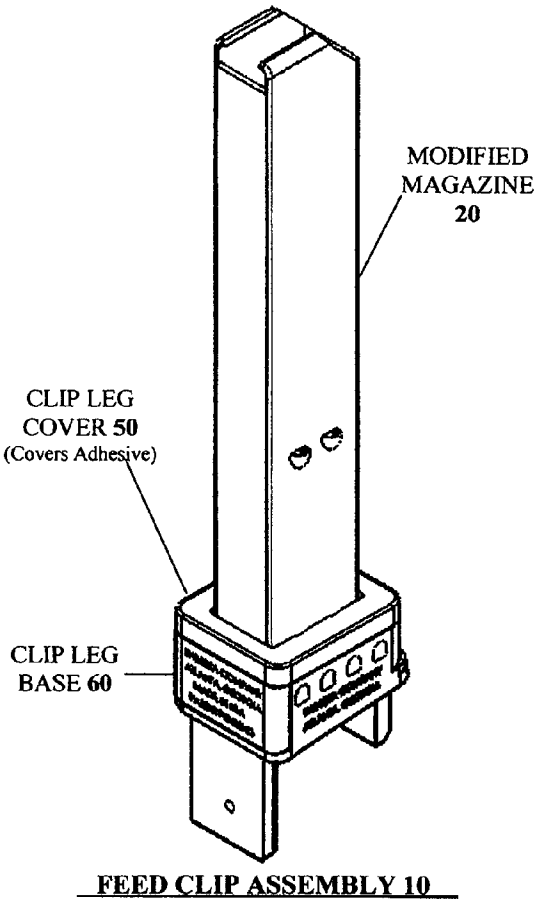
FIG. 7C shows a complete feed clip assembly including a modified magazine 20, clip leg base 60, and clip leg cover 50 (the adhesive is installed but is not viewable due to the presence of the clip leg cover 50).
Figure 7B:
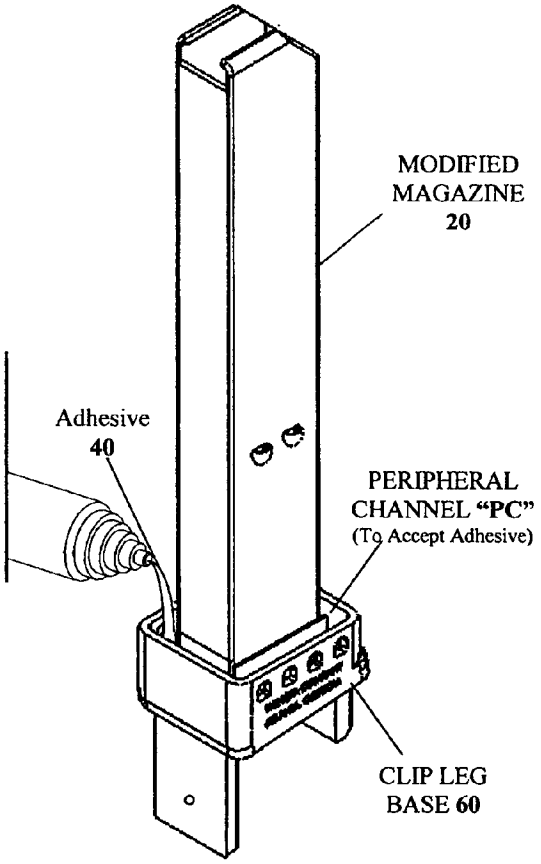
FIG. 7B shows a modified magazine 20 positioned relative to a clip leg base 60 according to the present invention, prior to adhesive being installed.
Figure 7A:
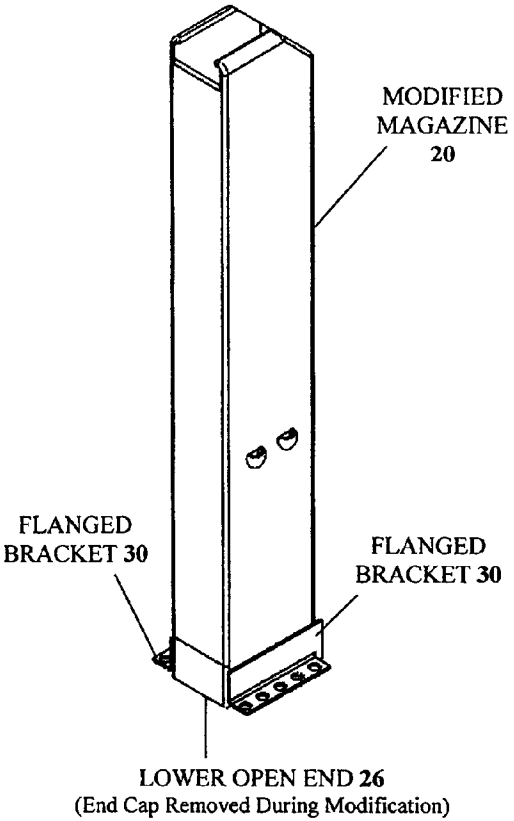
FIG. 7A shows flanged brackets 30 attached to a modified magazine 20.

The lower end is then prepared as needed to facilitate the welding or other suitable attachment of flanged brackets 30 (see FIG. 6 for exploded view, FIG. 7A for attached view).

Clip Leg Base 60

Once the flanged brackets 30 are attached as shown in FIG. 7A, the bottom of the modified magazine 20 (the end with the brackets) is inserted into the upwardly-directed cavity in the top of the clip leg base 60, as shown in FIG. 7B.

With the modified magazine 20 and the clip leg base 60 in the relative positions in FIG. 7B, it may be understood that an upwardly-directed peripheral channel is defined proximate the lower edge of the modified magazine 20 and inside the upwardly-directed cavity in the top of the clip leg base 60.

Each clip leg base 60 will be unique to a particular caliber. Depending on the configuration of the modified magazines 20 used, a single clip leg base 60 could be common to all magazines, or there could be slight modifications as needed for particular magazines.

In one embodiment, the clip leg base 60 is made of high impact plastic such as know in the industry, although other materials may be used without departing from spirit and scope of the present invention.

As may be understood, the clip leg base 60 is for use within the feed clip assembly for use with a particular double drum housing of a Beta C-MAG or other high capacity ammunition magazine housing having an ammunition outlet.

Epoxy/Adhesive 40

Adhesive 40 is poured or otherwise directed into this channel, such that in one embodiment the adhesive 40 fills the channel, and extends substantially to the upper edge of the peripheral lip provided by the clip leg base. An example of the filling of such a channel is shown in association with another embodiment of the invention in FIG. 16.

Once the adhesive 40 cures, it may be understood that it binds the modified magazine 20 and the clip leg base 60 together. Some adhesive 40 may leak out of the adhesive engagement holes 65 of the clip leg base 60, but it may be trimmed as needed. Adhesive may also need to be trimmed from the top to fit the clip leg cover 50.

Figure 9A:
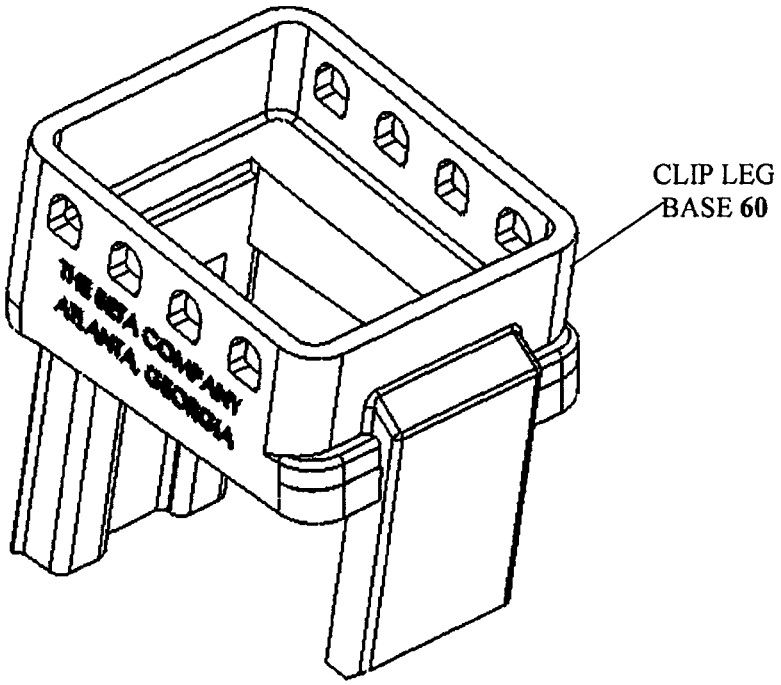
FIGS. 9A and 9B are perspective views of the clip leg base 60.
Figure 9B:
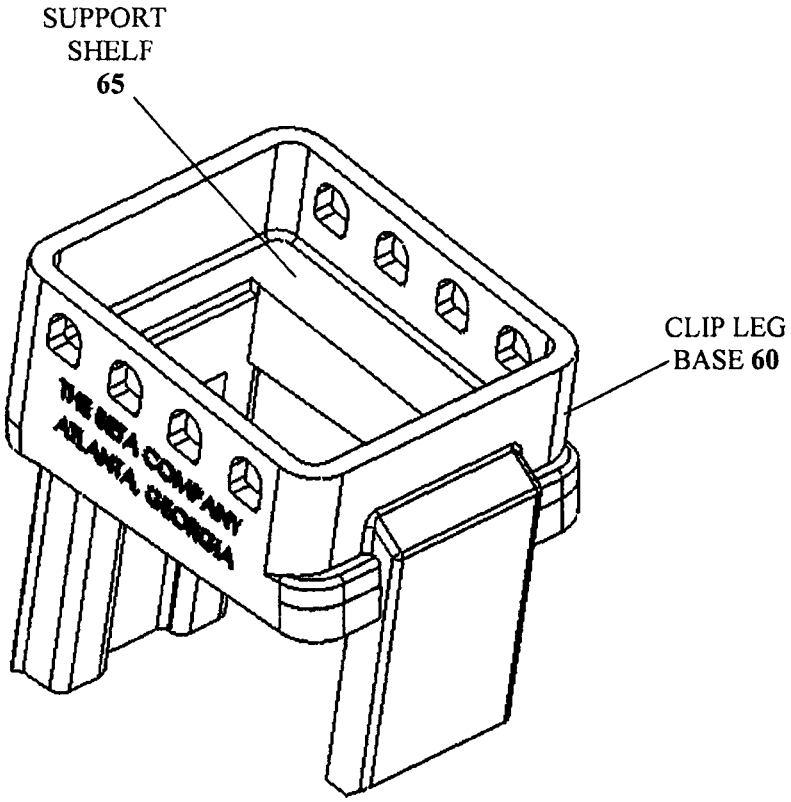
Figure 10:
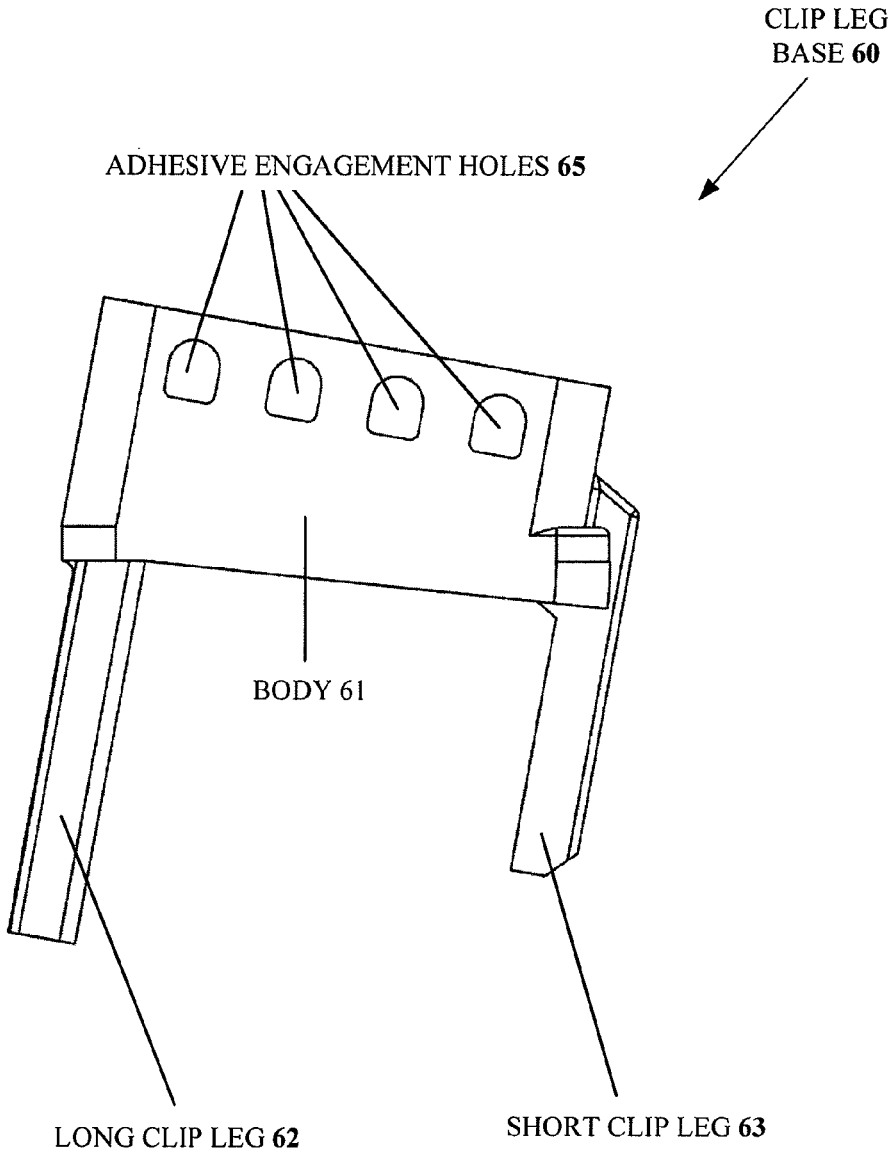
FIG. 10 is a side plan view of the clip leg base 60.
Figure 11:
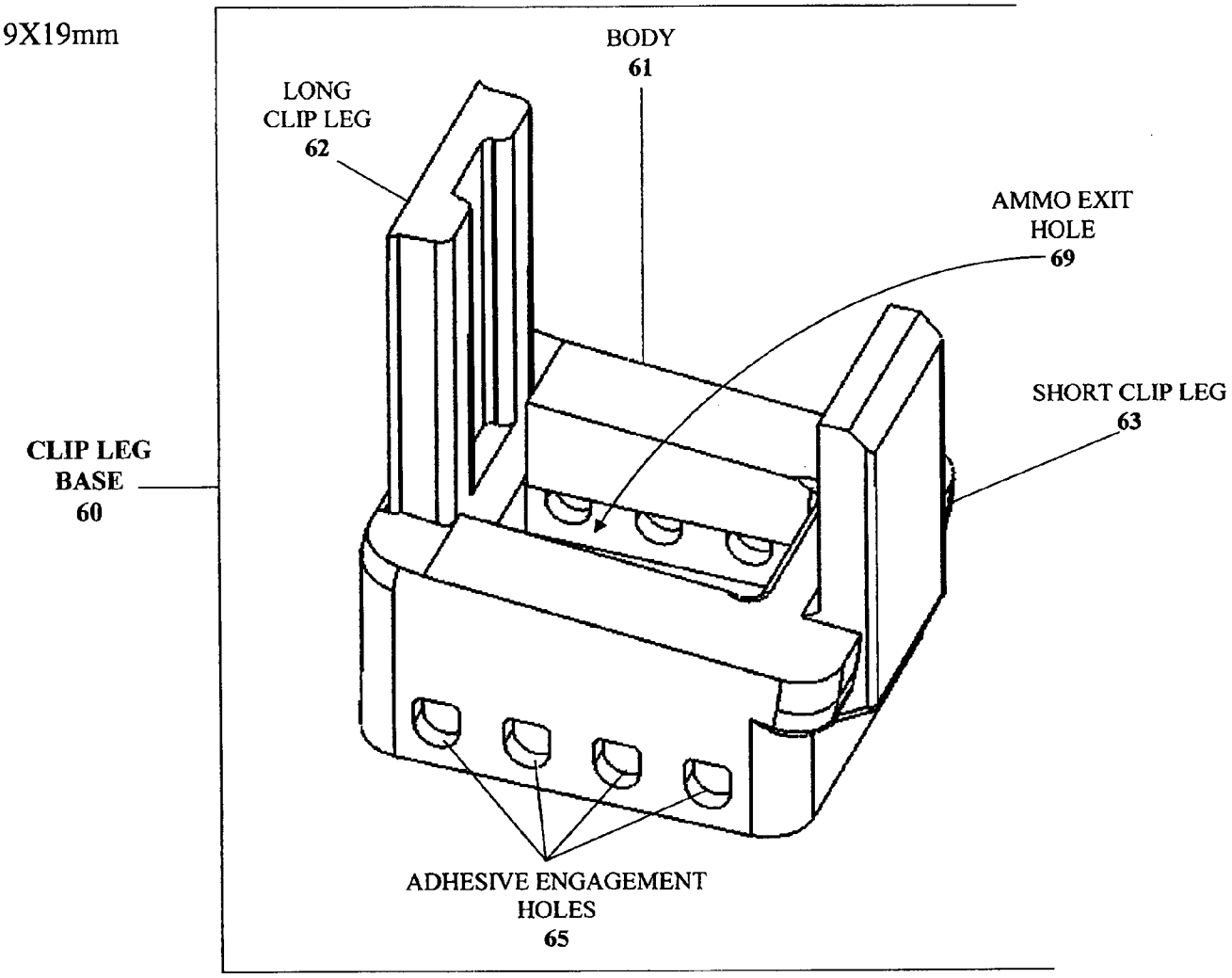
FIG. 11 is a perspective view of the clip leg base 60, looking somewhat from the top down through the ammunition exit passageway hole 69.
Figure 12:
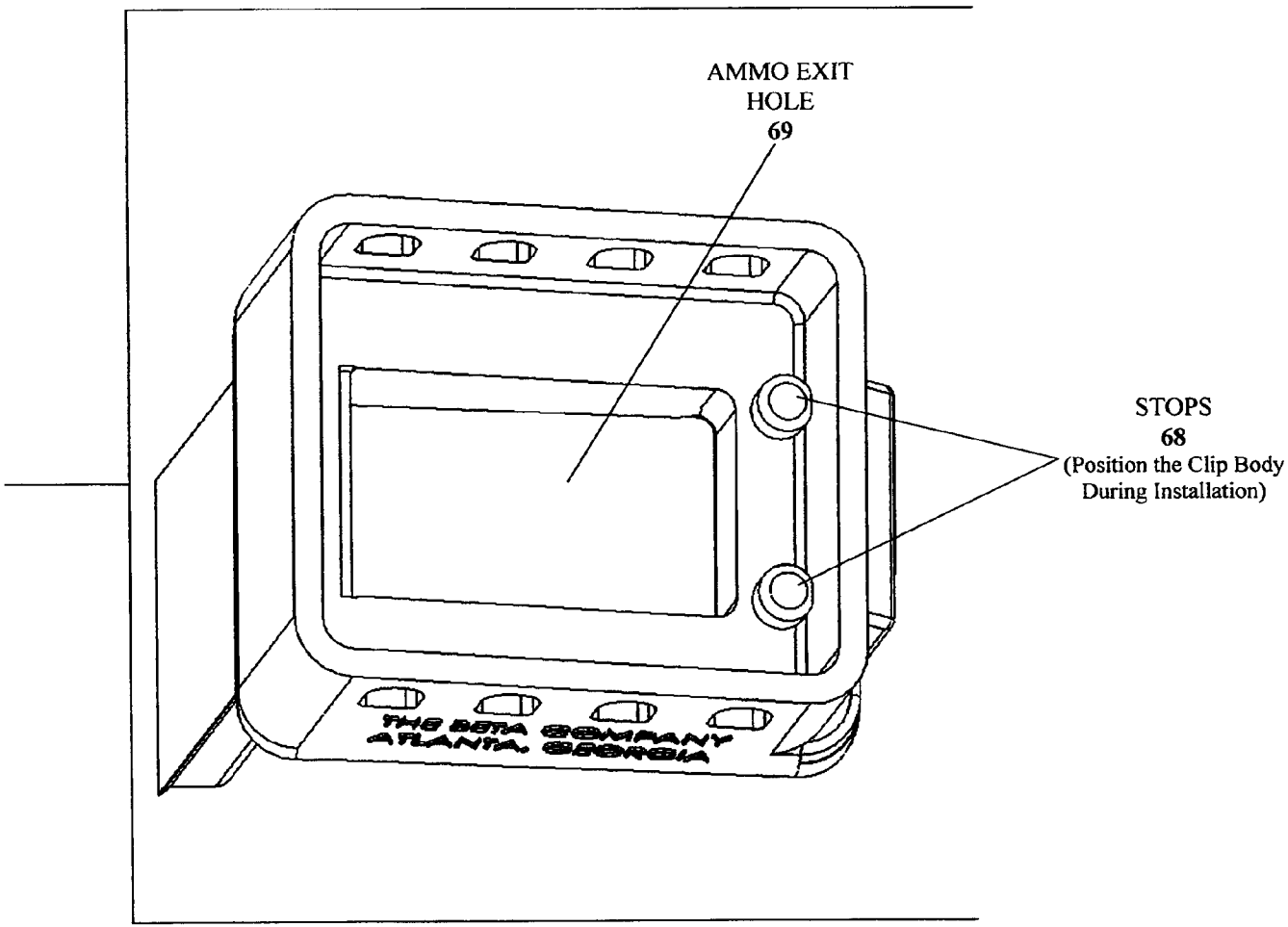
FIG. 12 is a reverse angle view of that shown in FIG. 11. The stops 68 position the flanged brackets on the clip body during assembly as discussed below.
Figure 13A:
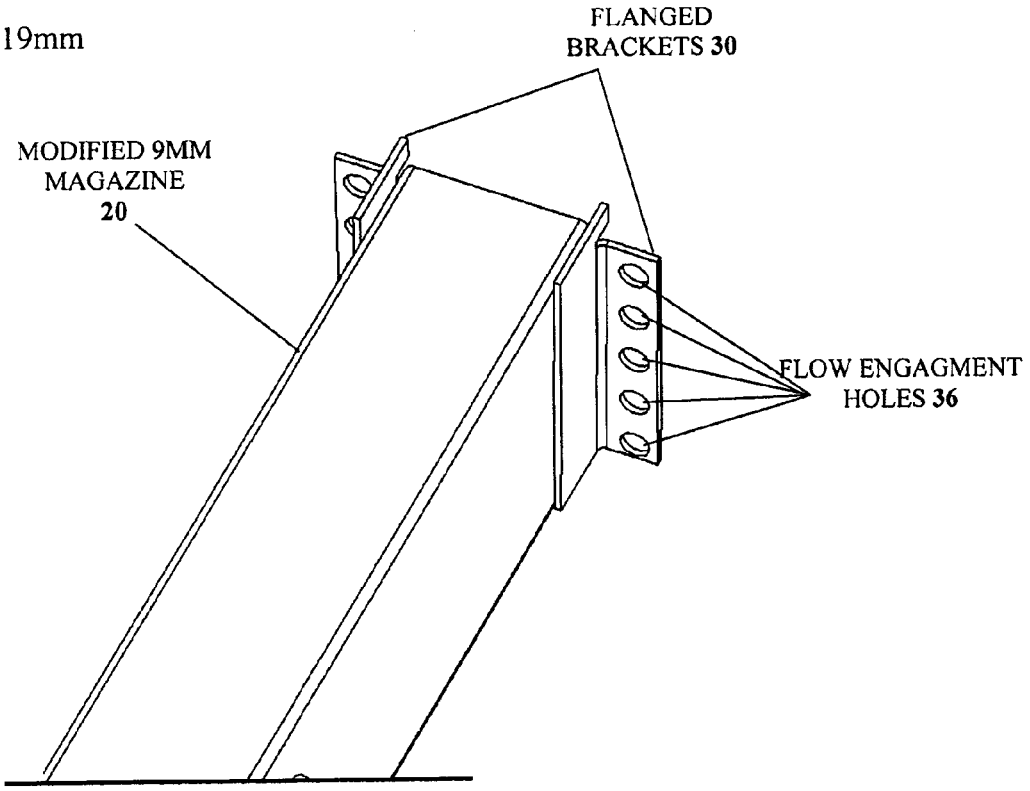
FIGS. 13A and 13B are perspective views showing the installed flanged brackets 30 on the modified magazine 20.
Figure 13B:
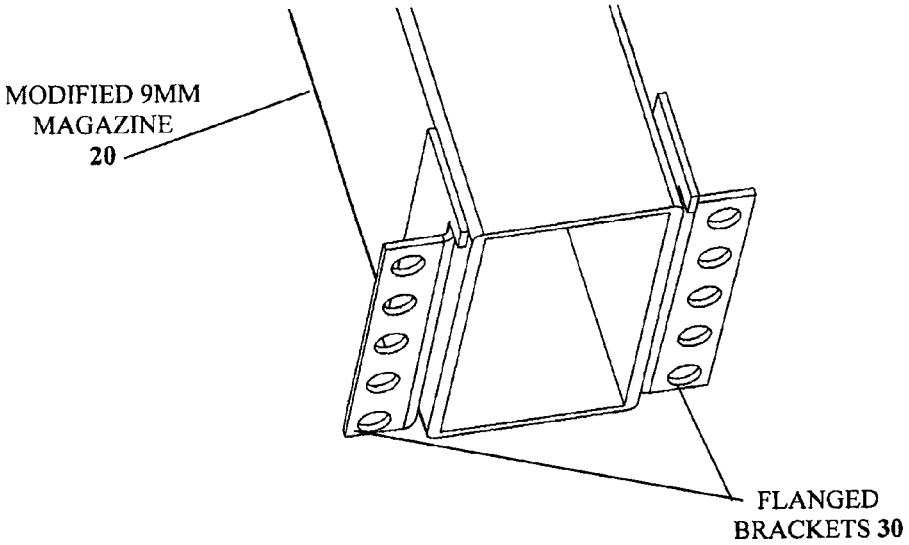

In one configuration the vertical flanges of the flanged brackets 30 bottom out on the interior support shelf 65 of the clip leg base 60 (see FIG. 9B). In one embodiment, the adhesive 40 is composed of urethane, although other moldable or pourable materials may be used without departing from spirit and scope of the present invention, such as an epoxy, or an elastomeric polymer.

The use of a flexible adhesive is one important feature of the invention, in that it provides a resistance to vibration via a damping effect.

Clip Leg Cover 50

After the adhesive 40 has cured, it is covered by use of a clip leg cover 50. The clip leg cover 50 is attached to the clip leg base 60 by glue, mechanical means such as friction pins, a combination of same, or other means known in the art.

Figure 8B:
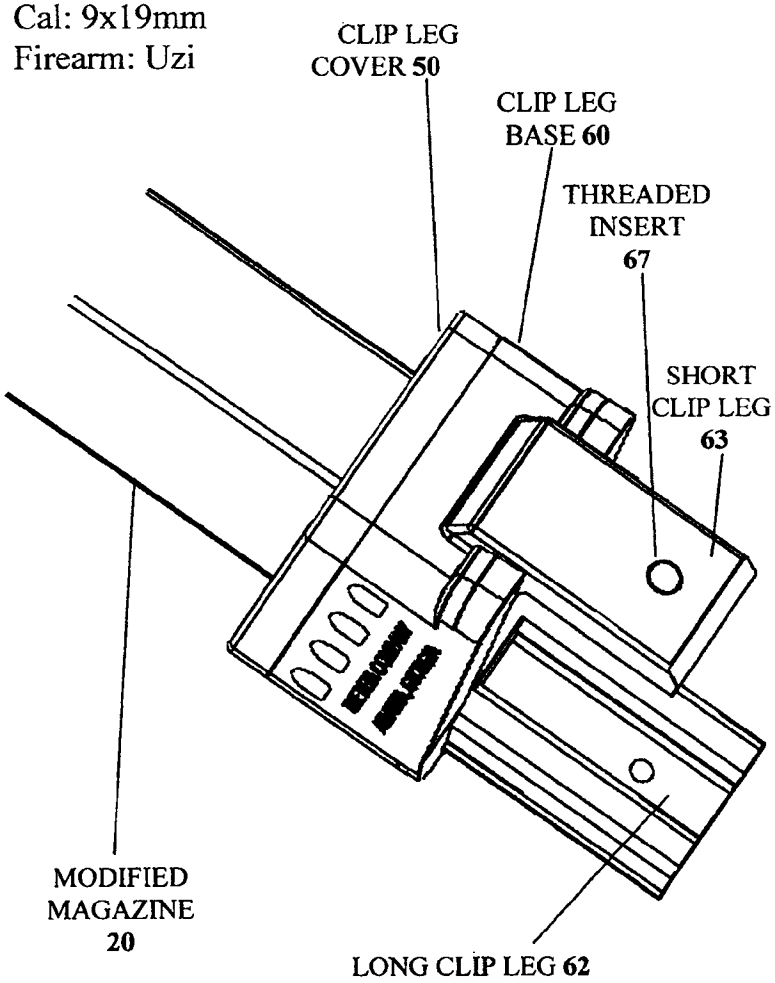
FIGS. 8A and 8B show the attachment of the clip leg base 60 and the adhesive cap 40 to the modified 9 mm magazine 20.
Figure 8A:
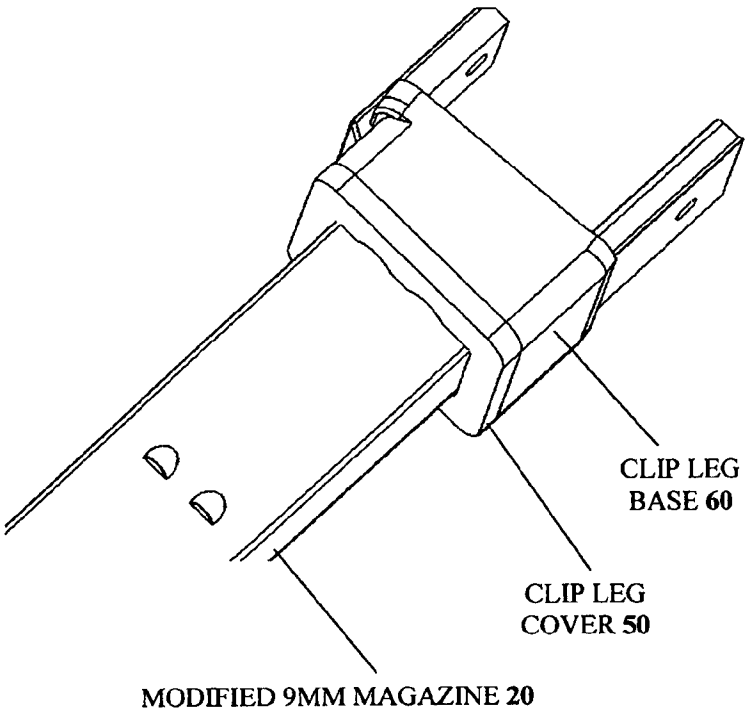
Figure 14A:
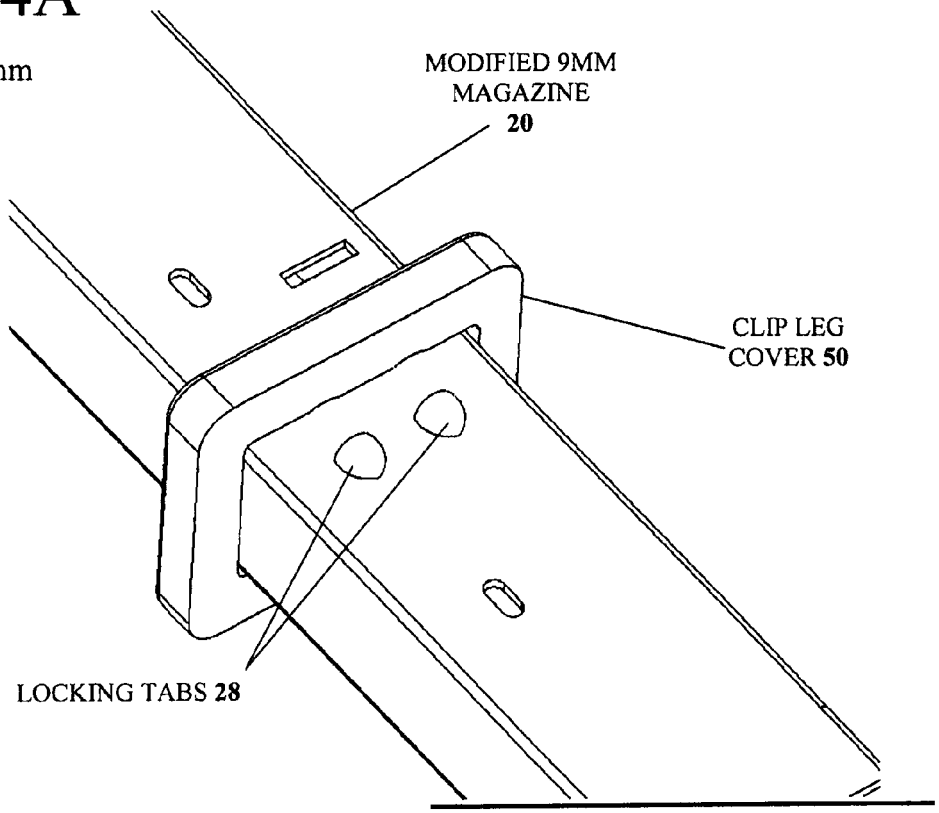
FIG. 14A is a more isolated view showing the clip leg cover 50 partly down the length of the modified magazine 20, adjacent the locking tabs 28 of the magazine.
Figure 14B:
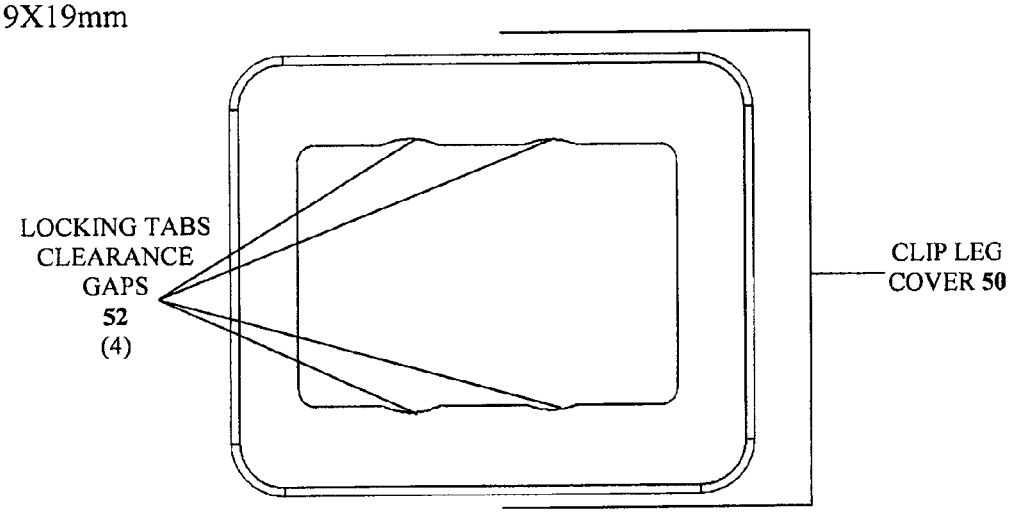
FIG. 14B is an isolated view of the clip leg cover 50, showing the four (4) locking tab clearance gaps 52 provided to clear the locking tabs of the modified magazine 20 as the clip leg cover 50 is installed.
Figure 15A:
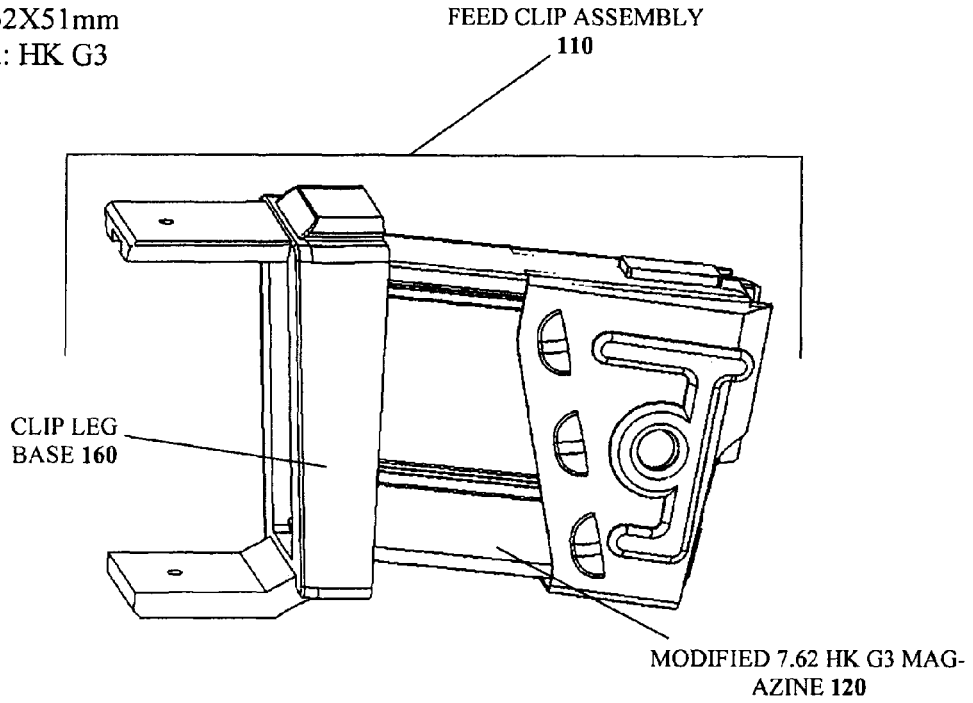
FIG. 15A is a view of a feed clip assembly 110 for an HK G3, using caliber 7.62×51 mm.
Figure 15B:
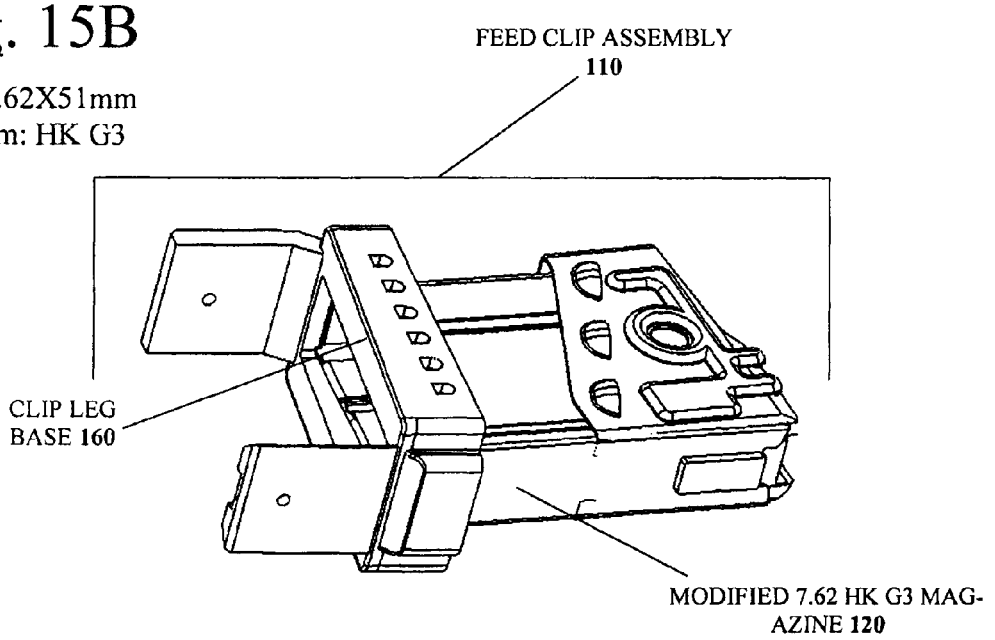
FIG. 15B is another view of that shown in FIG. 15.
Figure 16:
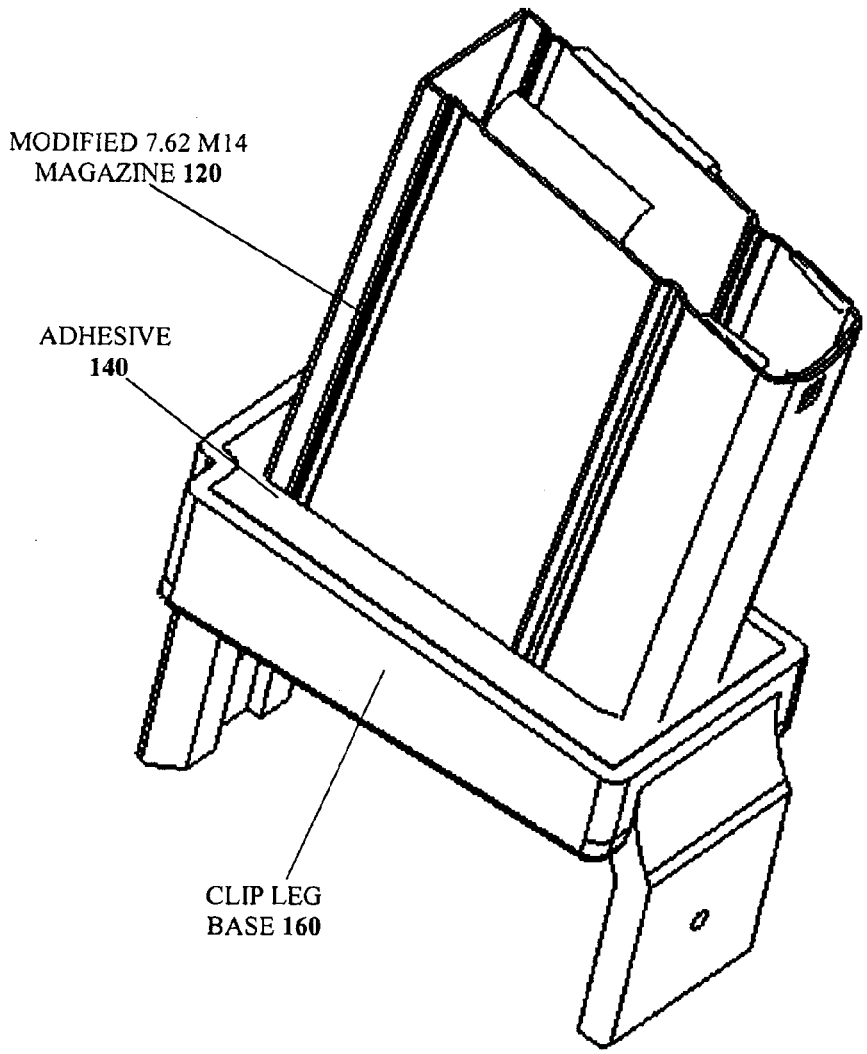
FIG. 16 is a view of a feed clip assembly 110 (for an M-14 this time) but without the clip leg cover, exposing the adhesive 140.
Figure 17:
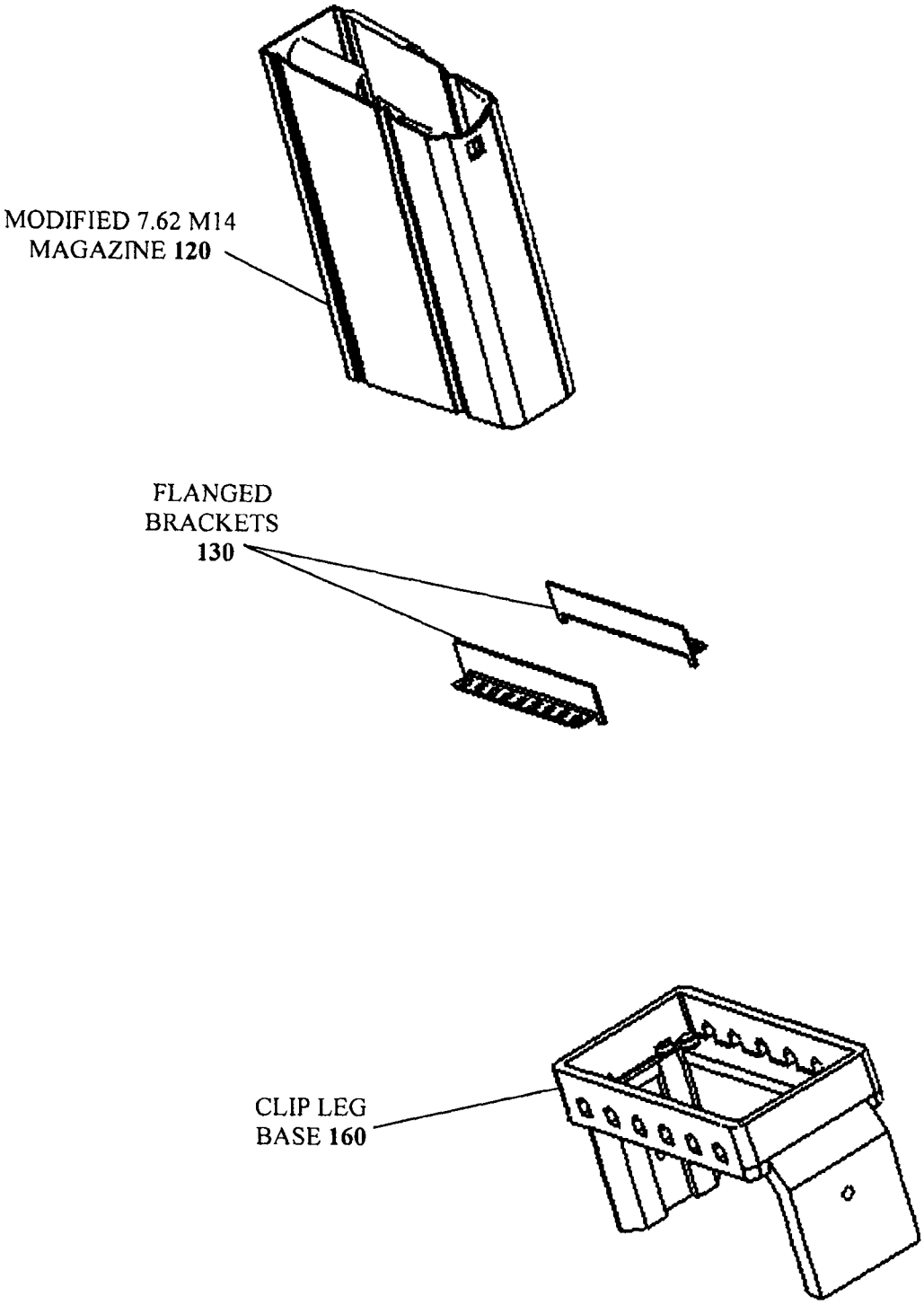
FIG. 17 is an exploded view of a feed clip assembly 110 of FIG. 17, but without the adhesive shown.
Figure 18:
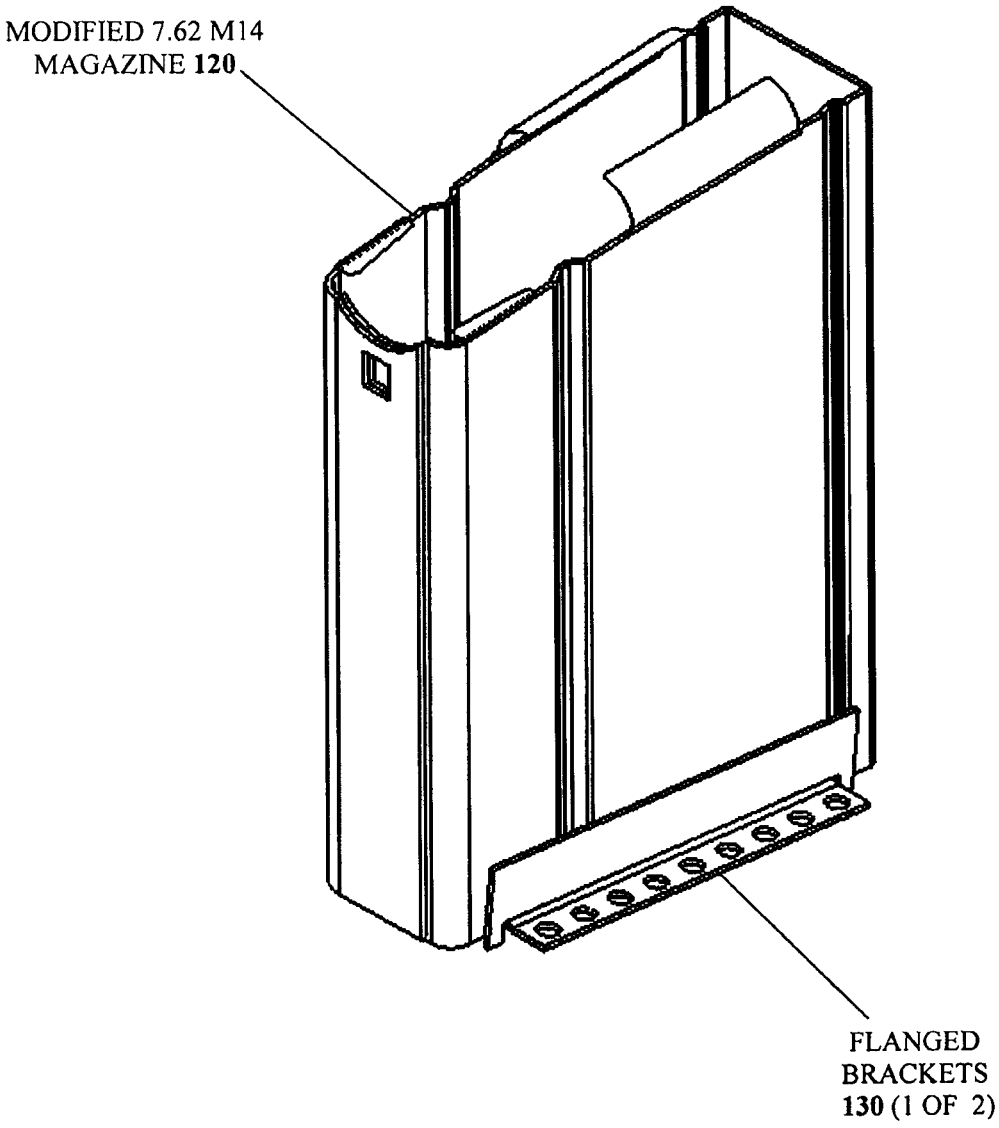
FIG. 18 shows a modified 7.62 M14 magazine 120 with a flanged bracket 130 installed. This view would not show the other bracket.
Figure 19A:
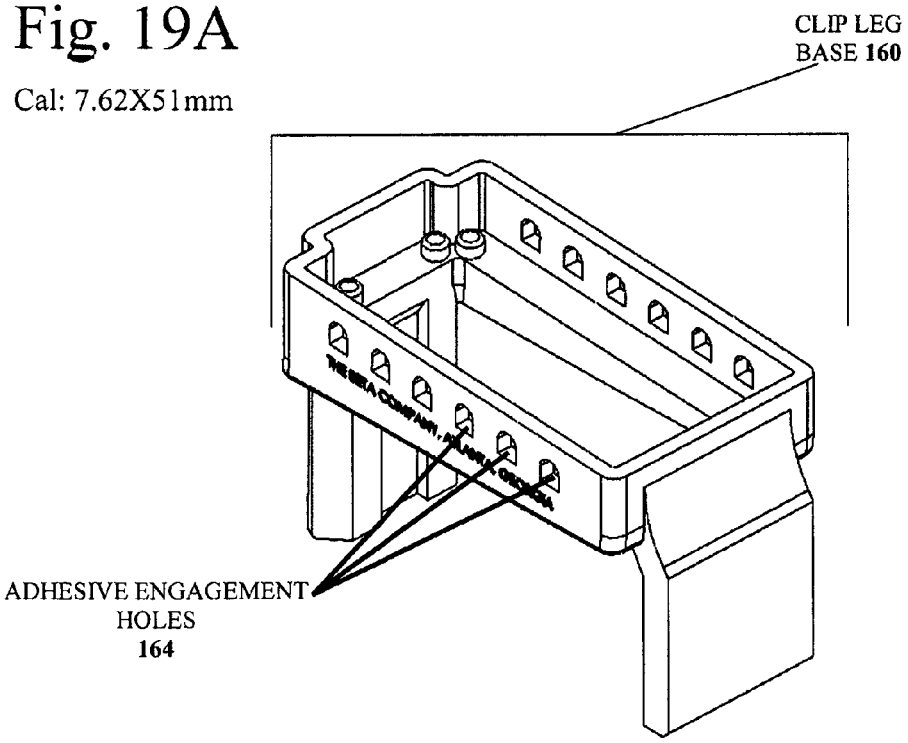
FIGS. 19A and 19B are perspective views of a clip leg base 160 according to the present invention.
Figure 19B:
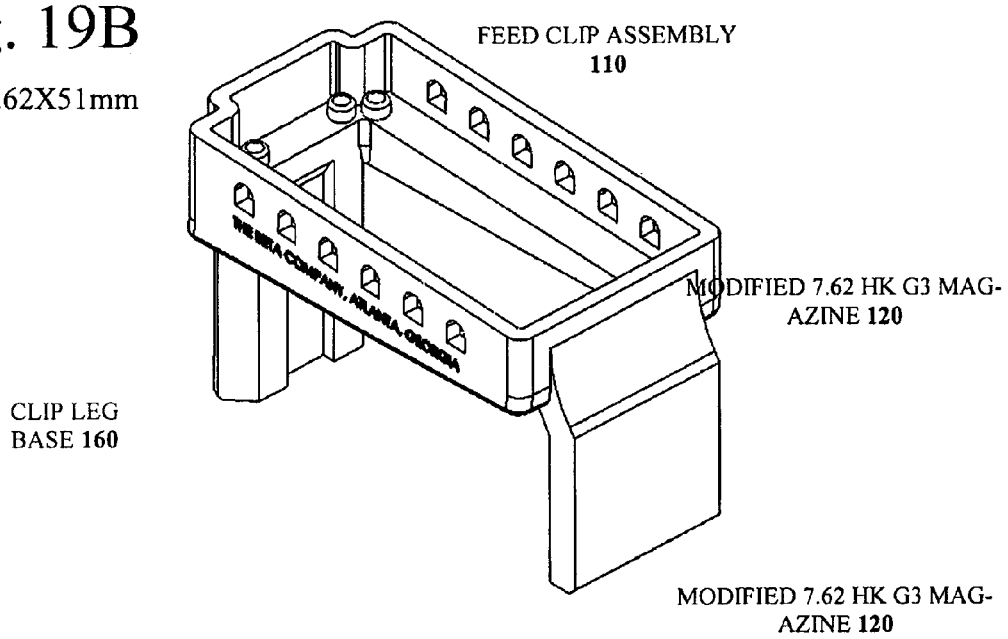
Figure 20:
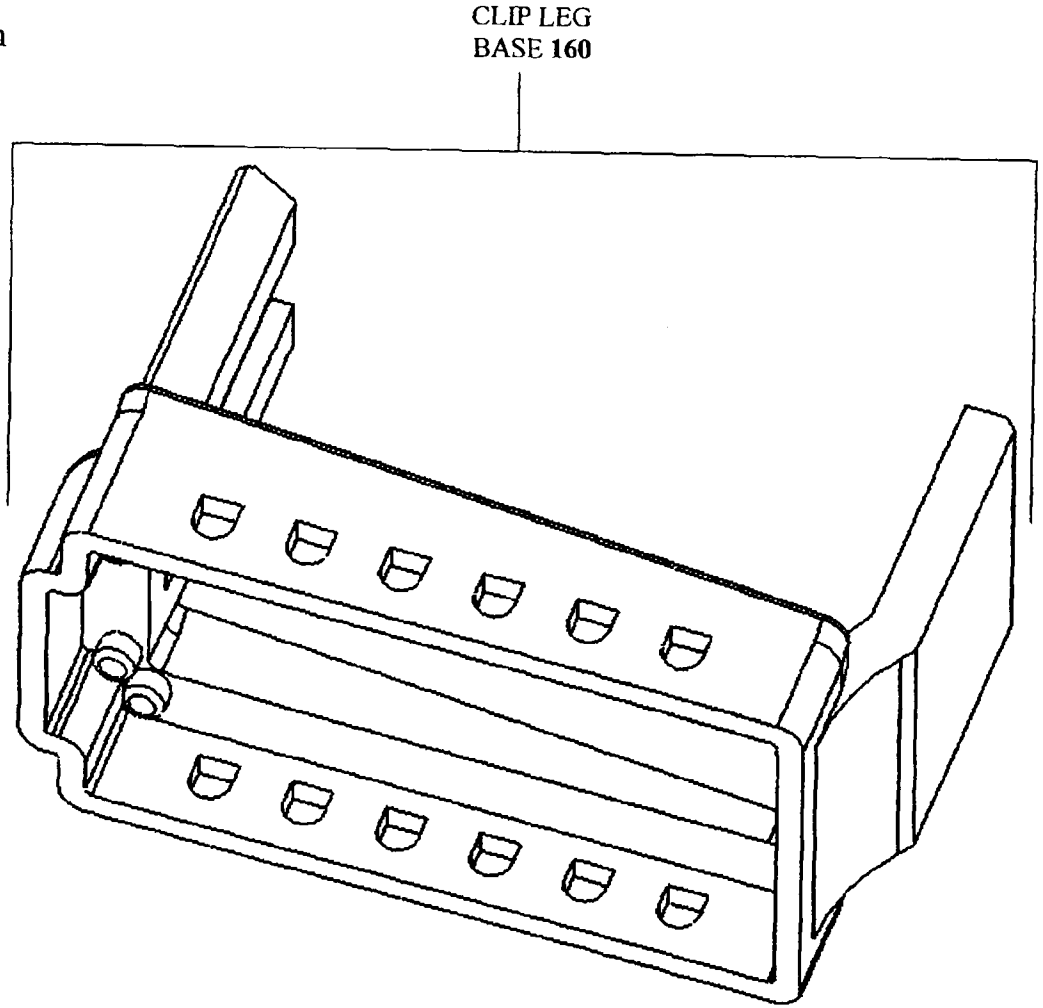
FIG. 20 is a perspective view of a clip leg base 160 according to the present invention. Note that in one configuration this base 160 can work with multiple magazines (e.g. M14 and HK G3) of the same caliber.
Figure 21:
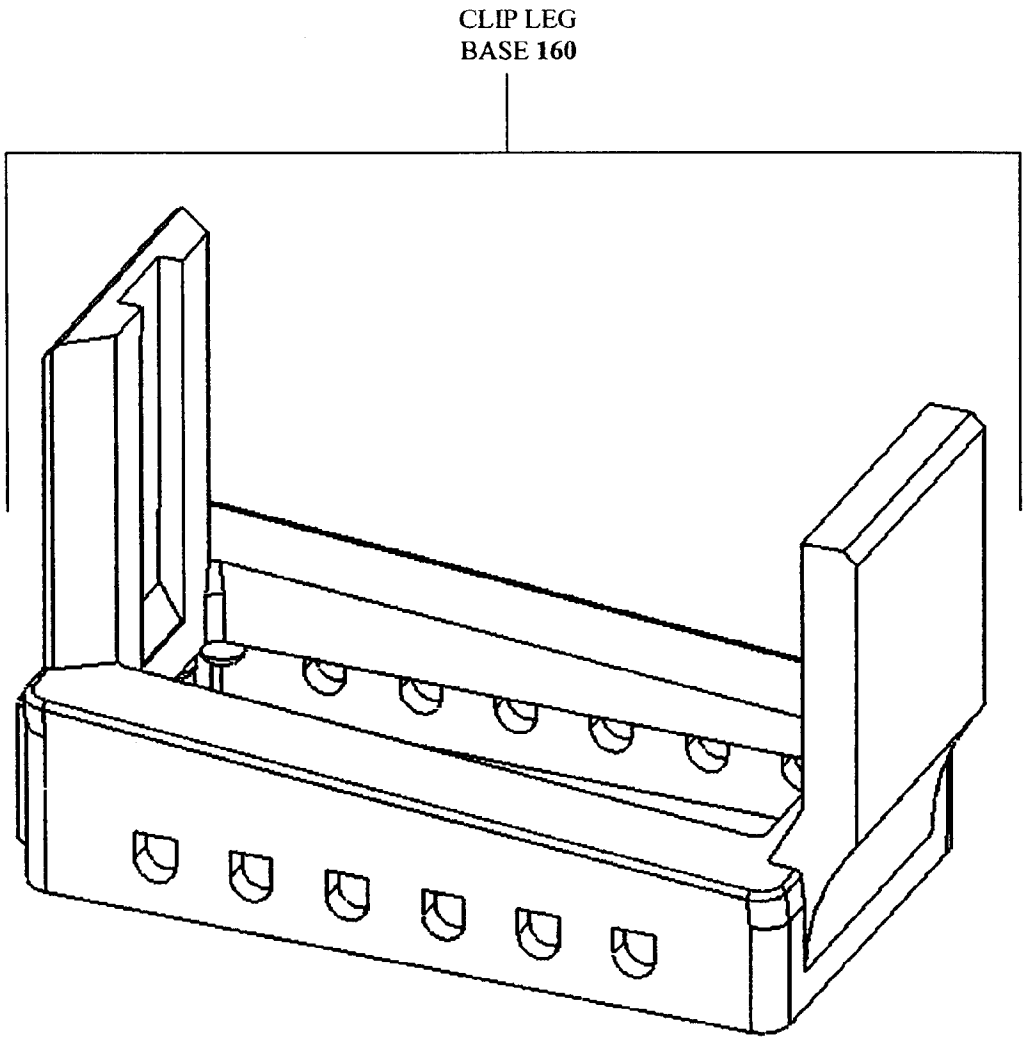
FIG. 21 is another perspective view of a clip leg base 160 according to the present invention
Figure 22:
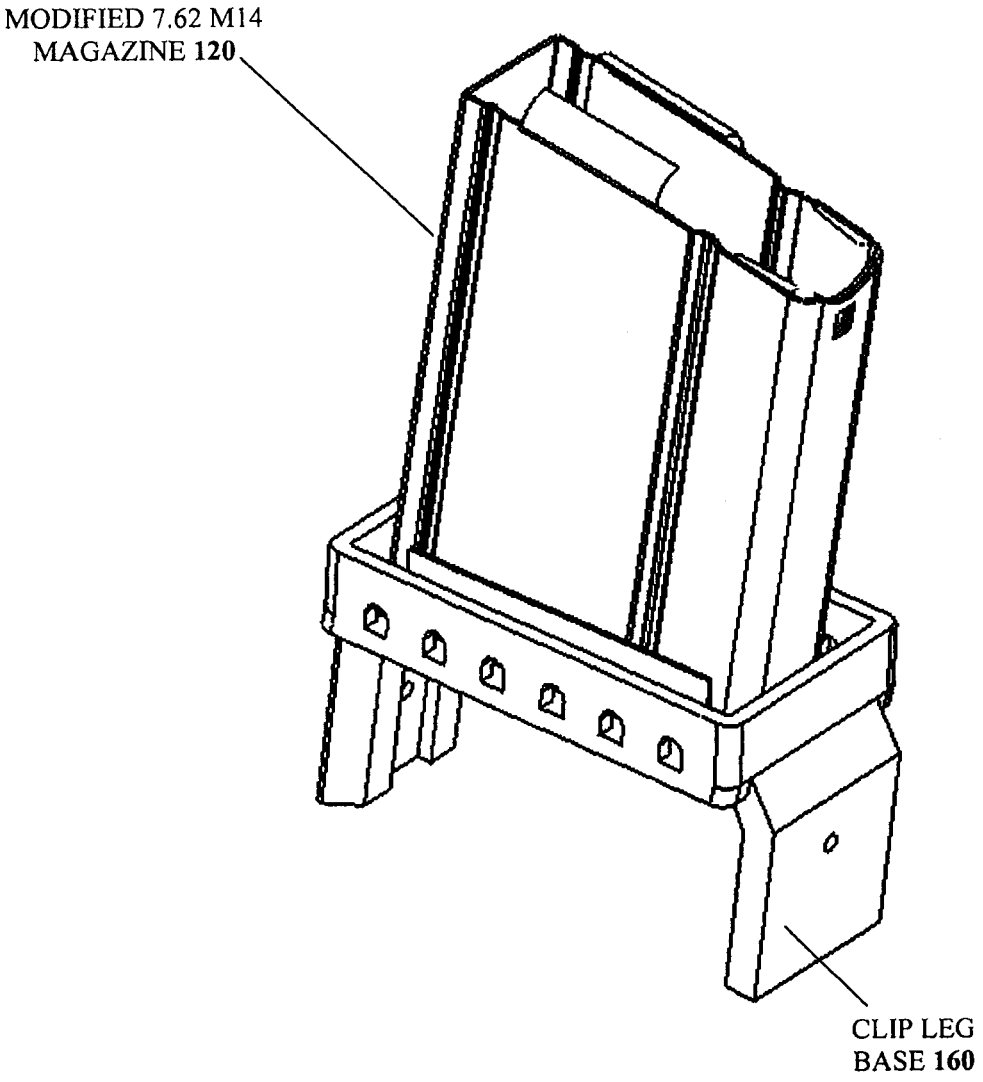
FIG. 22 is a perspective view of a clip leg base 160 according to the present invention with a modified 7.62 M14 magazine 120 in place thereon in a position suitable for the addition of the adhesive.
Figure 23:
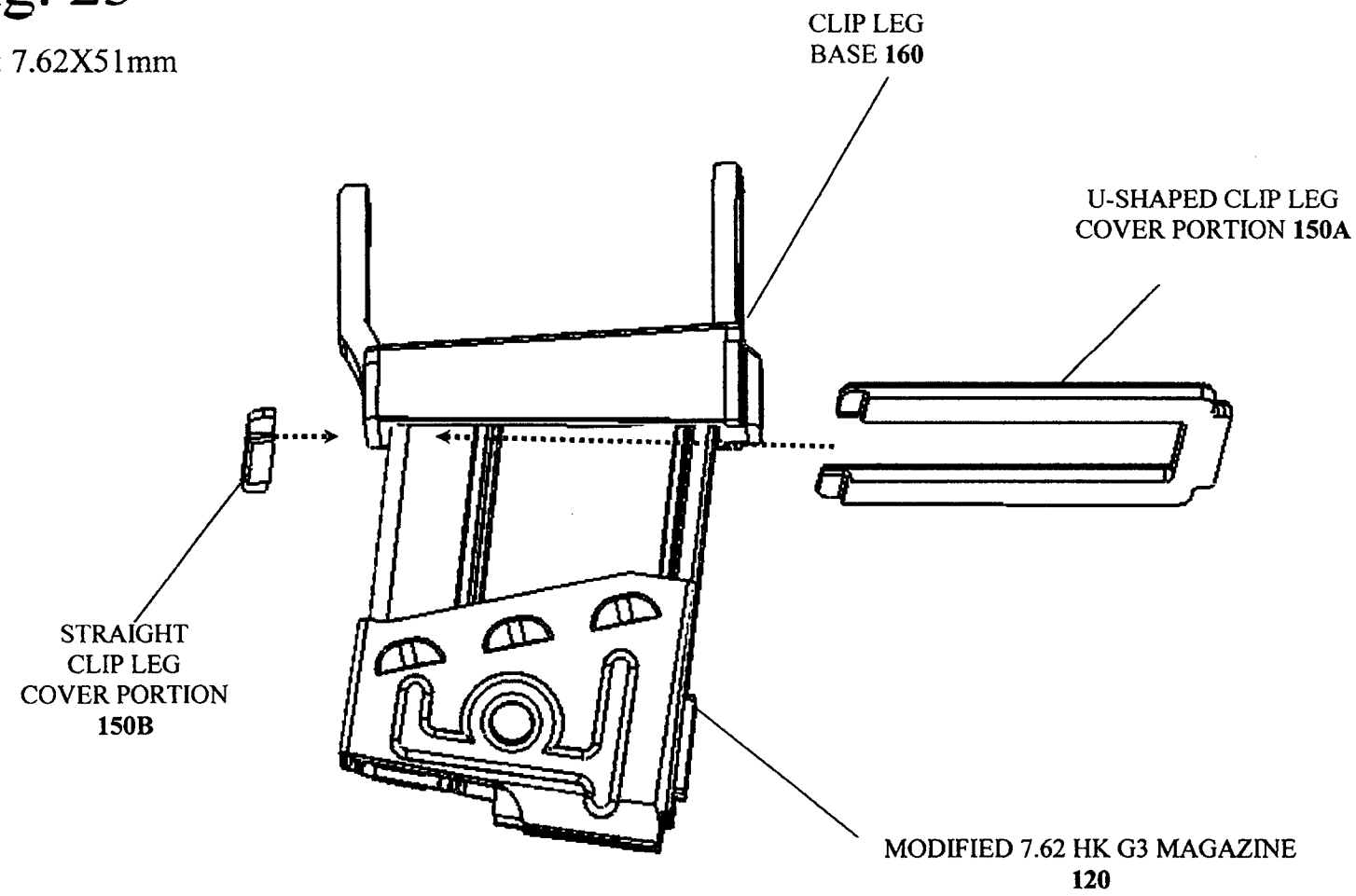
FIG. 23 shows the installation of the U-shaped clip leg cover portion 150A and the straight clip leg cover portion 150B.
Figure 24A:
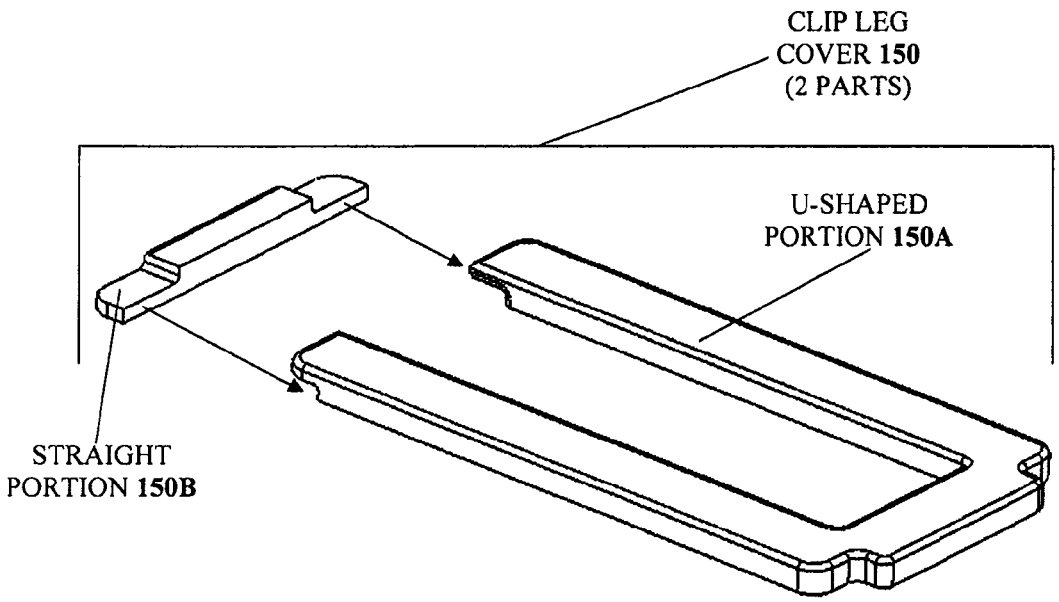
FIGS. 24A and B illustrates the relative assembly of two parts 150A, 150B of the clip leg cover portion 150.
Figure 24B:
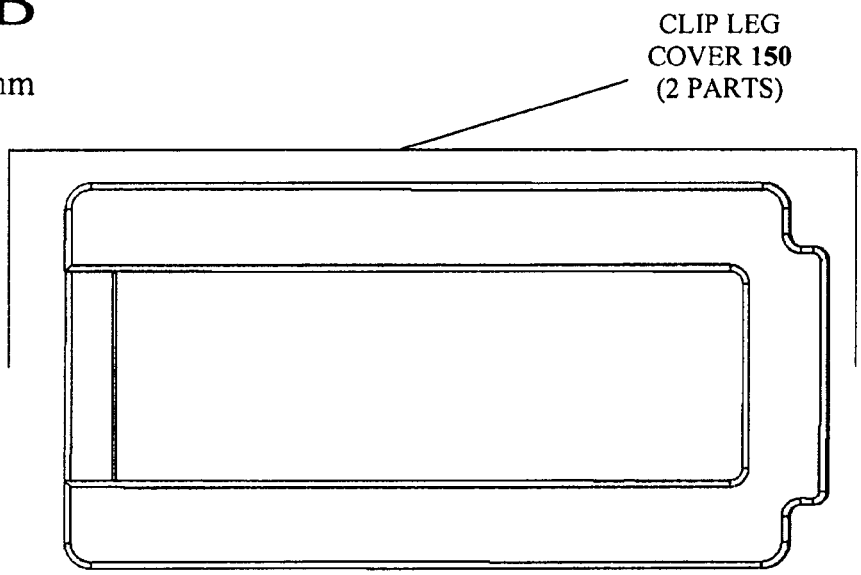

In the instance of the 9 mm UZI configuration of FIG. 1, the clip leg cover 50 is slid over the upper end of the modified magazine 20 such as shown in FIG. 14A, until it is in the position such as shown in FIGS. 1 and 8A-8B, wherein it is then fixed in place.

Note that the clip leg cover for other 9 mm assemblies may have different clearance gaps or may consist of two parts such as the 7.62 mm clip leg cover described below. Various other designs could include self-locking features.

In one embodiment, the clip leg cover 50 is made of nylon or another plastic, although other materials may be used without departing from spirit and scope of the present invention.

Completion of Feed Clip Assembly 10

At this point the conversion of a magazine to a feed clip assembly 10 is completed. It should be understood that various painting, Parkerizing, etc., processes could be used in the conversion process as are found suitable and/or necessary.

Attachment of Feed Clip Assembly 10 to Drum Housing 7

In order to attach the feed clip assembly 10 to the drum housing 7, the feed clip assembly 10 is first filled with a number of spacer rounds (number varies depending on the type of feed clip) and a last-round-link-assembly and is attached to the center of the double drum housing 7 of a Beta C-MAG magazine unit to result in a completed magazine, which can then be installed into the firearm.

In the UZI design shown, forty (40) loose spacer rounds and one last-round-link-assembly are used. In the 7.62 mm design shown, two (2) linked strings of nine (9) spacer rounds each are used, with the strings adjacent to each other but one jogged forward a half round diameter to facilitate a "double stack"-type nesting of the spacer rounds. However it may readily be understood that the number of rounds can change depending on the weapon type and the design of the magazine well of the weapon.

The last-round-link assembly is basically two rounds that are linked together with tapered ends to allow the weapons bolt to close on an empty C-MAG and prevent the last round to be chambered.

The lower end of the feed clip assembly 10 is attached to a double drum housing 7 of a Beta C-MAG magazine unit by the use of the same hardware used to attach a single piece molded feed tube such as 3 shown in FIG. 3. This hardware includes a clip strap 4 and two clip strap (machine) screws 4*s*.

One screw 4*s* passes through one hole in the clip strap 4, through the long clip leg 62 of the clip leg base 60, and engages a threaded hole defined by the double drum housing 7. The other screw 4*s* passes through the other hole in the clip strap 4, and threadably engages a threaded insert 67 in the short clip leg 63 of the clip leg base 60. Tightening of the screws 4*s* fixes the lower end of the feed clip assembly 10 to the double drum housing 7. Removal is the opposite of installation.

7.62 M14 Version

The configuration of the 7.62 Version shown in FIGS. 15-24 is quite similar in function, if not appearance, as the 9 mm Uzi configuration, with a few differences.

In the case of the 9 mm Uzi configuration, as discussed above, during installation the clip leg cover 50 is one piece and slides down the empty modified magazine 20. In the case of the 7.62 M14 version, the clip leg cover 150 is made of two pieces 150A, 150B, in order to the U-shaped part be installed transversely to then be joined with a straight piece to complete the clip leg cover 150. This configuration is used due to shape of the modified 7.62 M14 magazine, which does not lend itself to installation of a clip leg cover from the upper end of the magazine.

Glock 9 mm Pistol Version (FIGS. 25-28)

A Glock Feed Clip Assembly 210 will now be described. Note that this type of assembly is not limited to a Glock pistol configuration per se—it could be applied to other similar firearm applications, particularly pistol configurations.

Figure 25A:
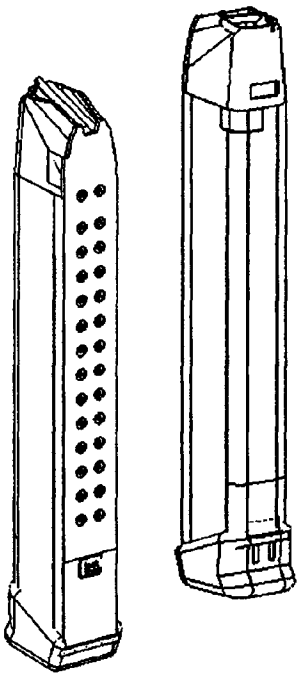
FIG. 25A shows different views of an unaltered 33 round Glock 9 mm pistol magazine.

Reference is now made to FIGS. 25-31, which relate to the use of an invention relating to a Glock 9 mm pistol configuration, in which a Glock 33 round magazine is used such as shown in FIG. 25A. Such magazines are modified according to one inventive concept herein, in order to provide a Glock Feed Clip Assembly 210 which can be used with a double drum housing 9 as described above.

Figure 25B:
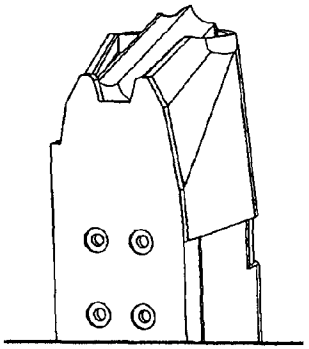
FIG. 25B shows details of the upper end of same.
Figure 25C:
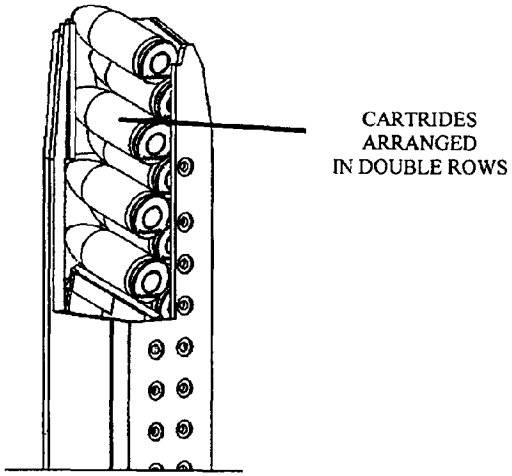
FIG. 25C shows a cutaway version showing the cartridges in double rows in the body of the magazine, but tapering to the center at the top.

FIG. 25A shows different views of an unaltered 33 round Glock 9 mm pistol magazine. FIG. 25B shows a details of the upper end of same. FIG. 25C shows a cutaway version showing the cartridges in double rows in the body of the magazine, but tapering to the center at the top. As may be seen, although a "double stack" in the majority of its body, the inside top of this unaltered Glock 9 mm pistol magazine 210 tapers down to accept one round at the top in the center of the clip. Other rounds further down in the unaltered Glock magazine 210 are in a staggered (a.k.a. double stacked) formation below this round. When the unaltered Glock 9 mm pistol magazine 210 is in place in a conventional Glock pistol (such as a G17, G19, or G23) the bolt in the Glock pistol contacts the rear of the top round and pushes it directly forward into the chamber.

The Glock pistol configuration in the previous paragraph is different from the other "double stacked" magazines which are modified as discussed above; the "other" magazines discussed in the previous sections are not tapered at the top, and present rounds in an alternating staggered relationship at the top. In these other magazines, rounds therein alternate from one side to the other and are not in the center of the clip as in the Glock pistol design. The bolt in the other weapons using these other magazines contacts the rear of the topmost round (regardless of what side it is on) and pushes it forward and to the center in order to insert the round into the chamber. In such other configurations, the standard last round link assembly used in clients previous U.S. Pat. No. 4,658,700 consists of two rounds, tapered at the rear, linked together that are placed on the same side of the feed channel of the magazine. The rounds are linked near their centers with a steel link (see e.g., FIG. 3 of U.S. Pat. No. 4,658,700, which shows such a link 40 that allows the rounds to be somewhat loose and rotate but tight enough to stay in wall to wall contact. A separate inert round is nested in between these two rounds on the opposite side of the clip. This inert round is identical to all of the other inert rounds that are included in the standard clip. This inert round is also shown in FIG. 3 of U.S. Pat. No. 4,658,700.

In light of this difference in the Glock pistol design, a new improved configuration has been developed to accommodate the Glock pistol design, allowing a Glock pistol magazine to be modified into a Glock Feed Clip Assembly 210 for use with a high capacity double drum housing 9 such as identified above, which provides improved feed and reliability features not previously known in the prior art. This includes an improvement from the previously described dummy cartridge and linking described in the previous U.S. Pat. No. 4,658,700. This "last round linked assembly" improvement may be used in conjunction with, or separate from, the Glock Feed Clip Assembly 210.

Figure 26A:
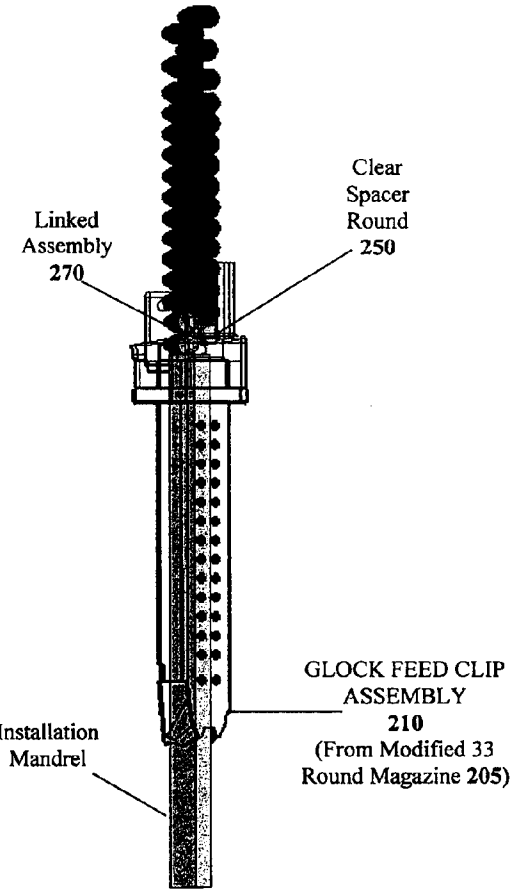
FIG. 26A shows a Glock Feed Clip Assembly 210 (made from modification of an unaltered Glock 9 mm pistol magazine 210) as the dummy cartridges and the clear spacer round and linked assembly are installed into the Glock Feed Clip via use of an installation mandrel.
Figure 26B:
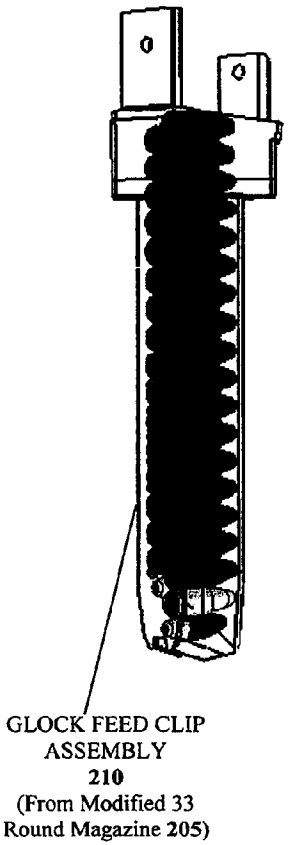
FIG. 26B shows the Glock Feed Clip Assembly 210 with all the spacer rounds installed and ready for installation onto the drum assembly.
Figure 26C:
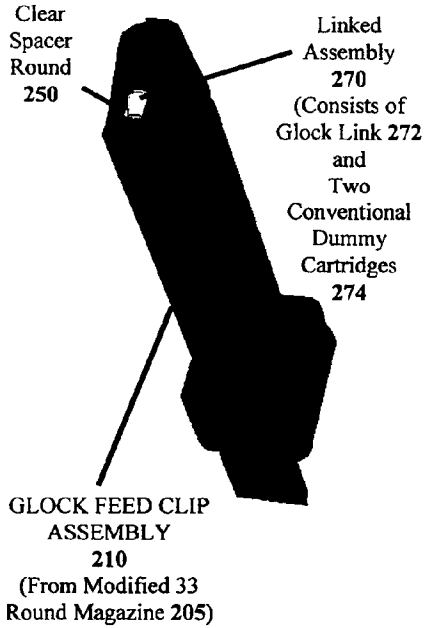
FIG. 26C is a pictorial view of the upper end of the Glock Feed Clip Assembly 210B (the part that would fit into the firearm mag well).
Figure 26D:
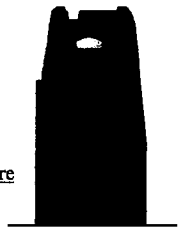
FIG. 26D is a partial elevational view of same.

FIG. 26A shows a Glock Feed Clip Assembly 210 (made from modification of an unaltered Glock 9 mm pistol magazine 210) as the dummy cartridges and the clear spacer round and linked assembly are installed into the Glock Feed Clip via use of an installation mandrel. This assembly 210 is made generally in the same ways as the previously described assemblies 10, 110 were made. FIG. 26B shows the Glock Feed Clip Assembly 210 with all the spacer rounds installed and ready for installation onto the drum assembly. FIG. 26C is a pictorial view of the upper end of the Glock Feed Clip Assembly 210B (the part that would fit into the firearm mag well). FIG. 26D is a partial elevational view of same. FIGS. 27A-D are more detailed partial views of portions of FIGS. 26A-D.

Figure 28:
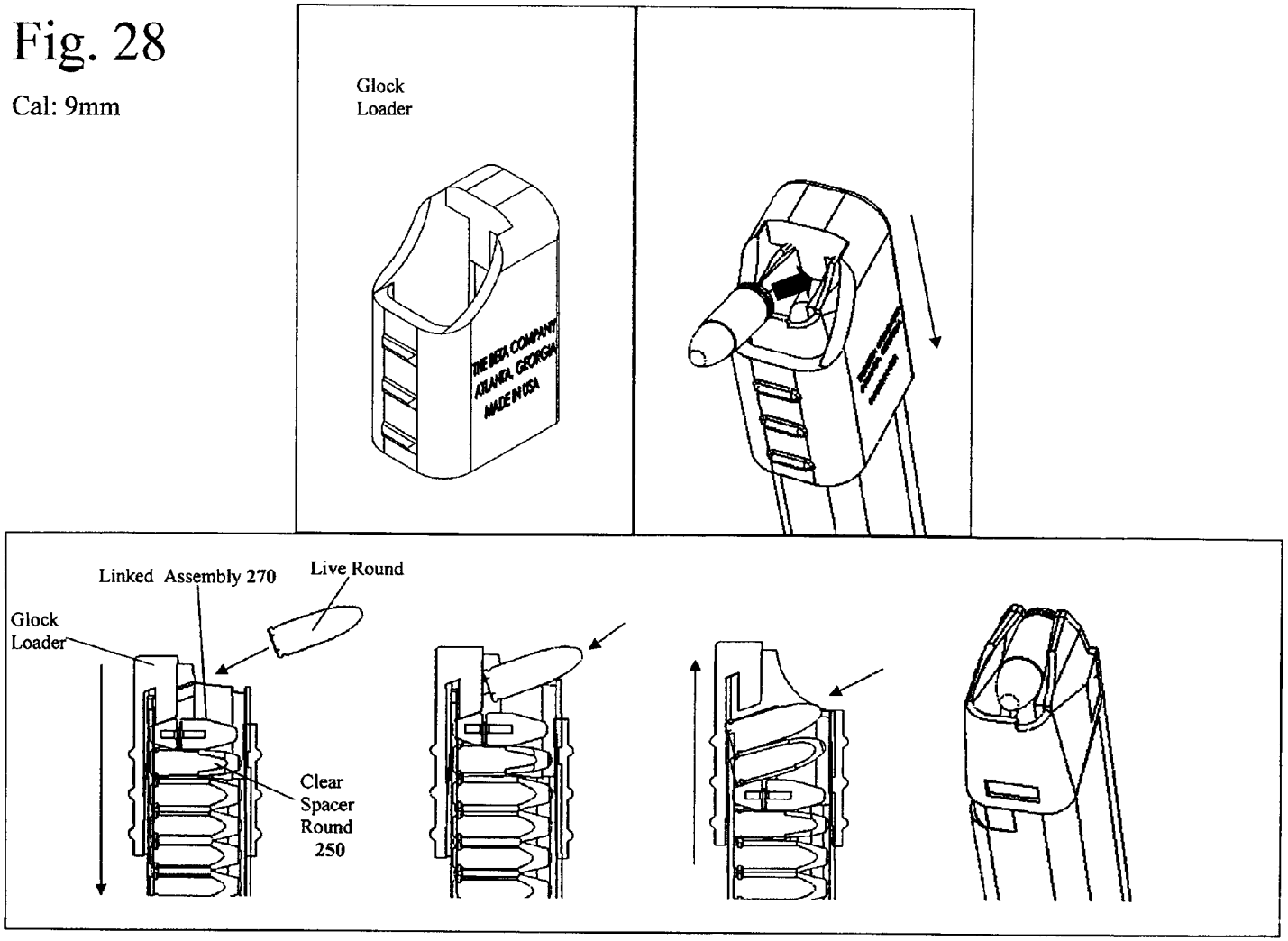
FIG. 28 shows various views of the first round being inserted into the Glock Feed Clip Assembly 210 with the use of a loader.

FIG. 28 shows various views of the first round being inserted into the Glock Feed Clip Assembly 210 with the use of a loader.

Figure 27A:
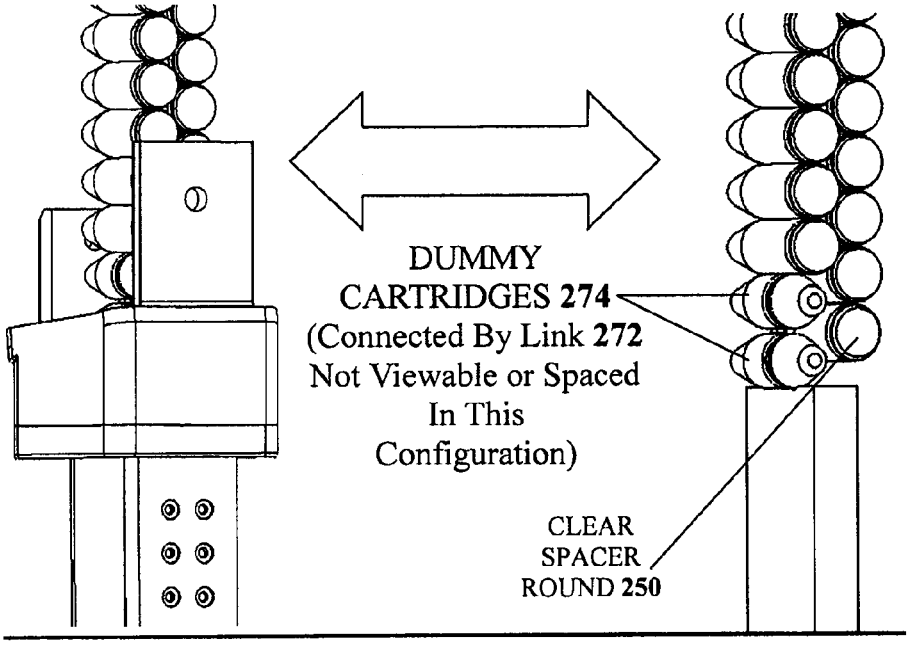
FIGS. 27 A, B, D, and E are more detailed partial views of portions of FIGS. 26A-D.
Figure 27B:
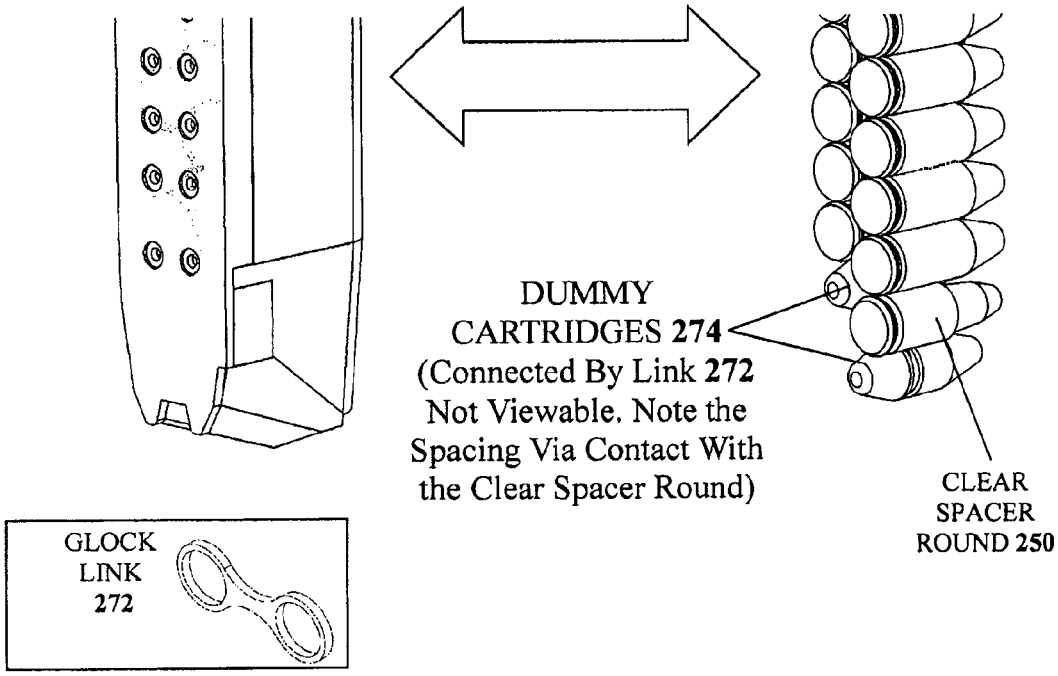
Figure 27D:
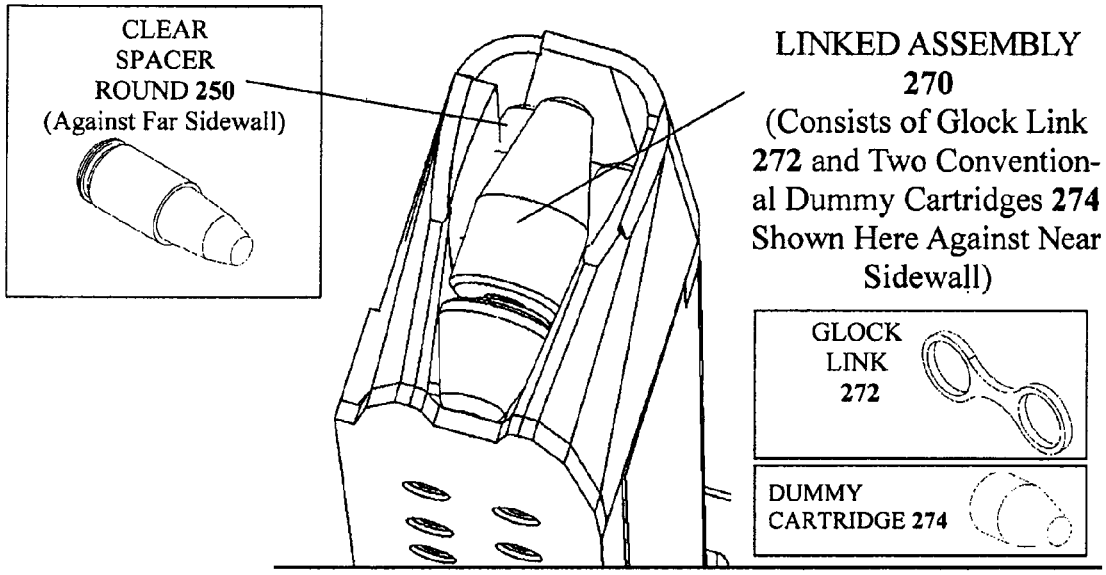
Figure 27E:
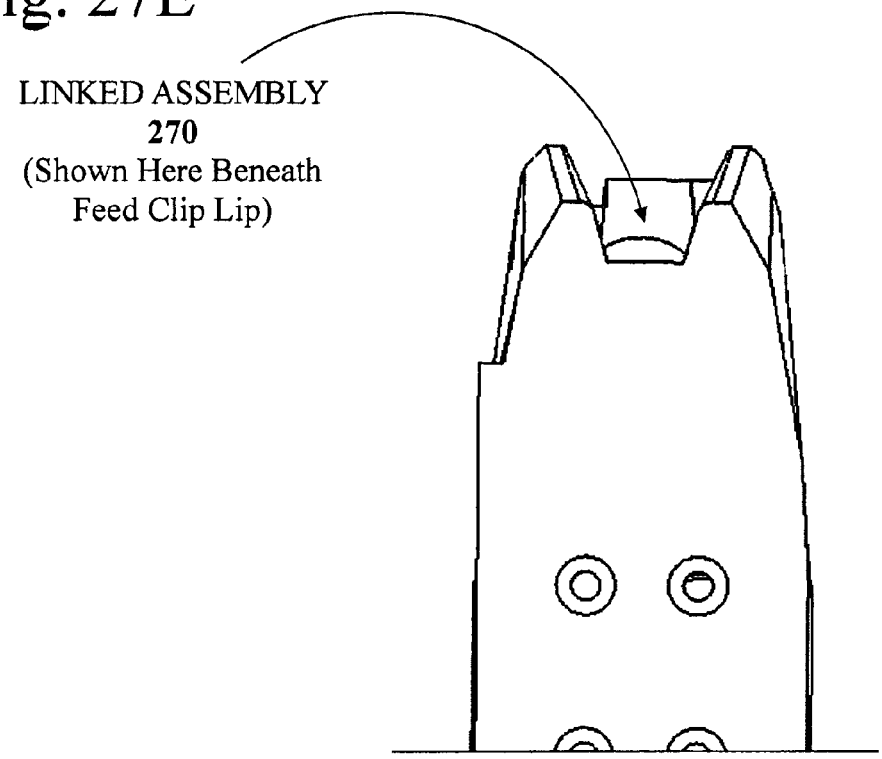
Figure 29A:
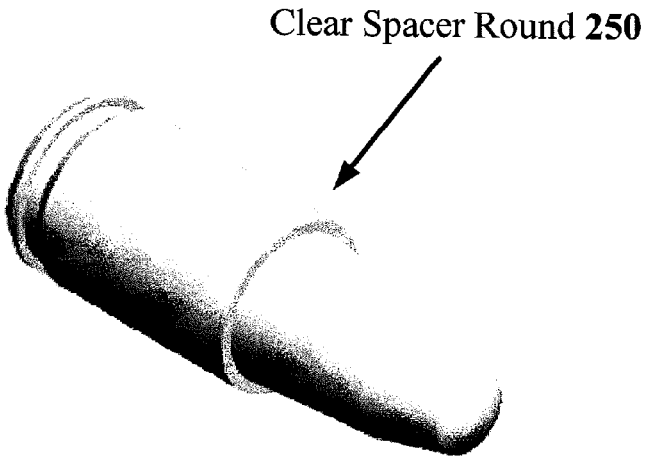
FIGS. 29A and 29B illustrate a clean spacer round.
Figure 29B:
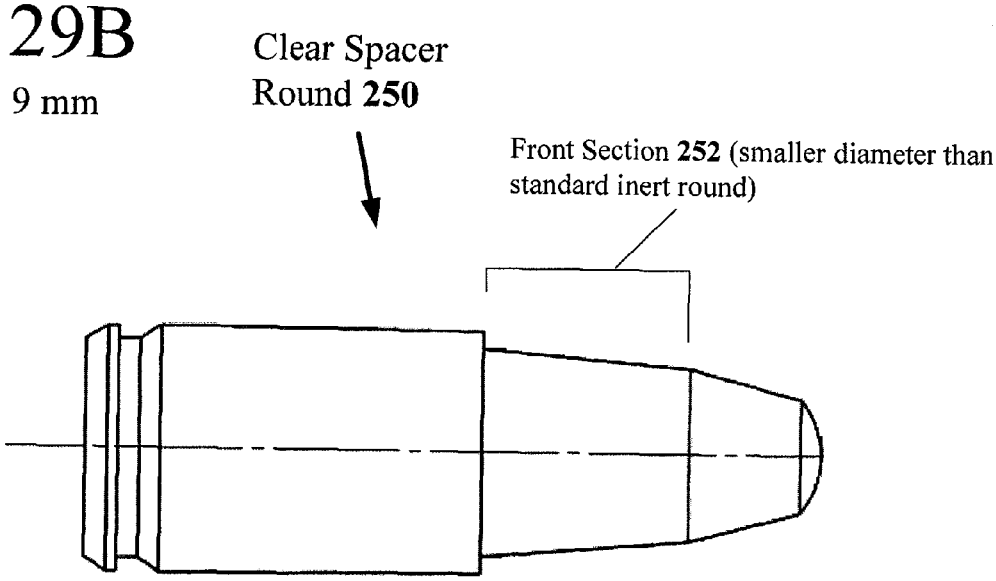
Figure 30:
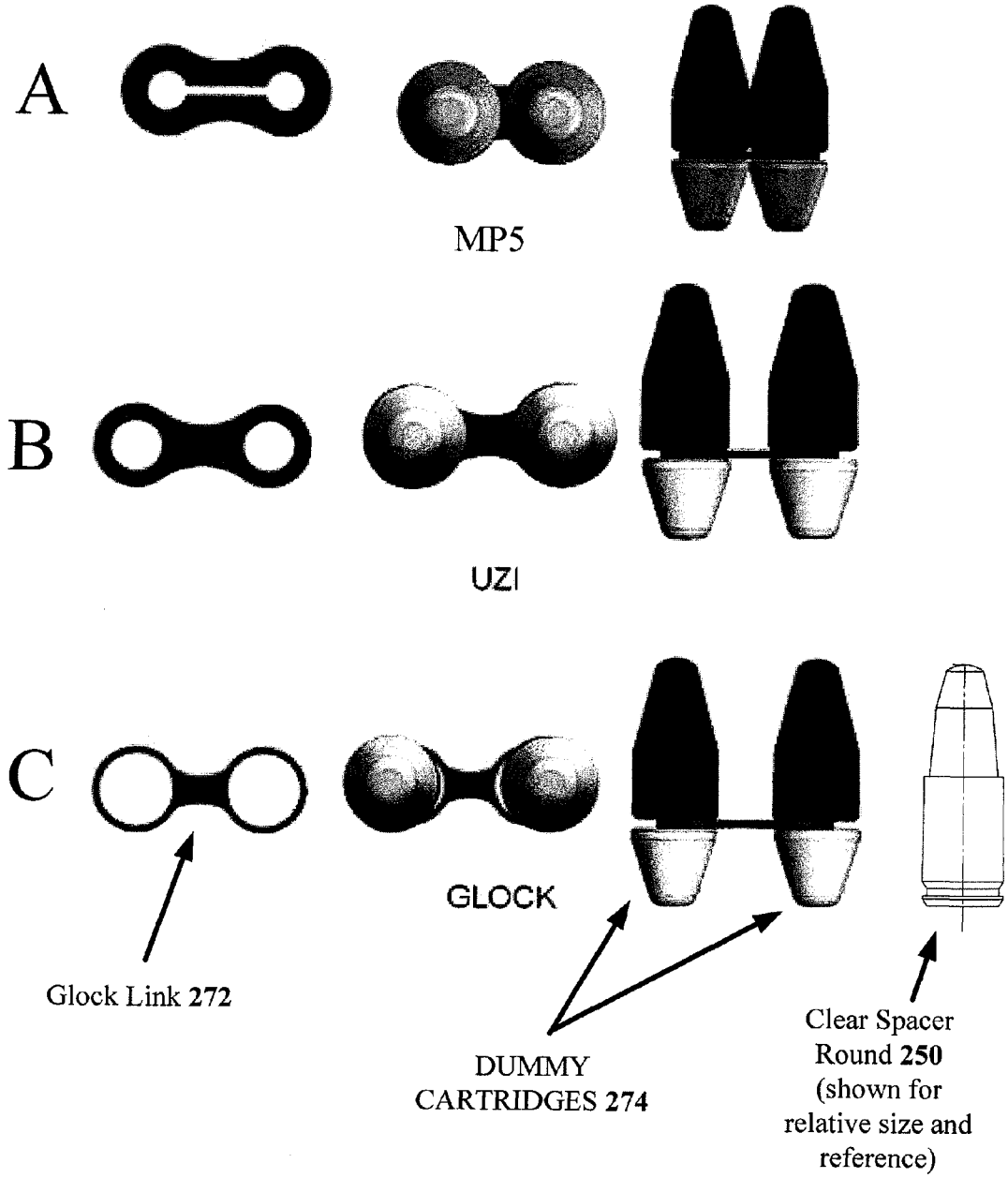
FIG. 30 shows various link configurations used with an MP5 (section A) and an UZI (section B). Section C of FIG. 30 shows the Glock Link 272.

The Glock last round linked assembly 210 used in conjunction with Glock Feed Clip Assembly 210 according to one of the current inventions consists of two dummy rounds 274 (each similar to the similar cartridges disclosed in U.S. Pat. No. 4,658,700, but here the two linked dummy rounds are tapered front and rear such as shown in FIG. 30, part C) These round 274 are linked together and positioned on the same side of the clip. The rounds are linked together near their centers, but with a specially designed steel "loose link" (aka Glock Link) 272 that allows the rounds to move apart by half their diameters as shown in FIG. 30, section C. A specially designed inert round 250 (aka Clear Spacer Round 250—called a Clear Spacer for reference but not really visually clear—made of suitable metal) as shown in FIG. 29A-B is nested in between these two rounds on the opposite side of the clip such as shown in FIG. 27D. This special inert "spreader" round 250 is not like the other inert rounds 274 that are included in the clip. While it has the same largest outside diameter as the other inert rounds, it has a smaller diameter at the front section 252 (see FIG. 29B) than the standard inert round. Note the different shapes of the elements 274 vs. the element 250 as shown in FIG. 31D. This round is pressed into the gap created by the spreading apart of the linked assembly. This configuration provides clearance at the top of the clip as shown in FIG. 27E needed to get past the taper in the inside of the Glock clip. The shapes of the linked assembly configuration in conjunction with the clear spacer round provide a type of "stop" that leaves the gap at the top and prevents the topmost link from coming up higher.

Because the top dummy cartridge of the linked assembly 210 is tapered at its rear, the bolt slides over it without contacting the rear. The bolt may contact the body of the link slightly, but it will not chamber the top part of the linked assembly 210. Its details are shown in FIG. 27C.

FIG. 30 shows various link configurations used with an MP5 (section A) and an UZI (section B). Section C of FIG. 30 shows the Glock Link 272.

Figure 31A:
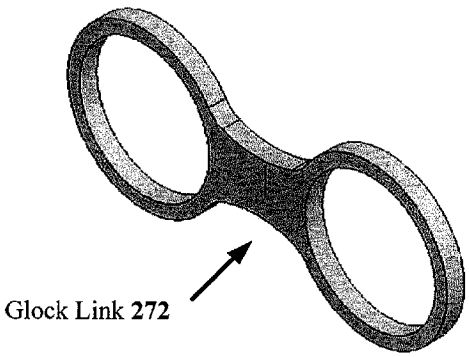
FIG. 31A and FIG. 31B show different isolated views of the Glock Link 272.
Figure 31B:
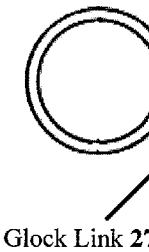
Figure 31C:
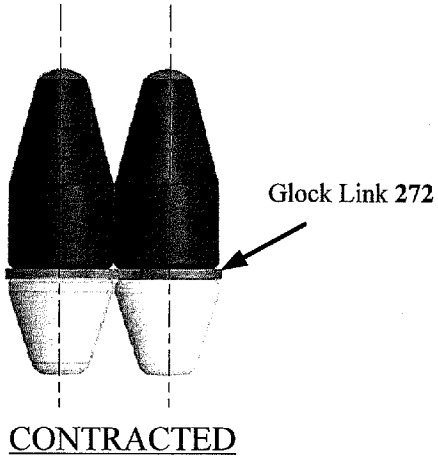
FIGS. 31C and 31D show the Glock last round linked assembly 210 in its contracted and expanded configurations, respectively, movement between said two being provided by the Glock Link 272.
Figure 31D:
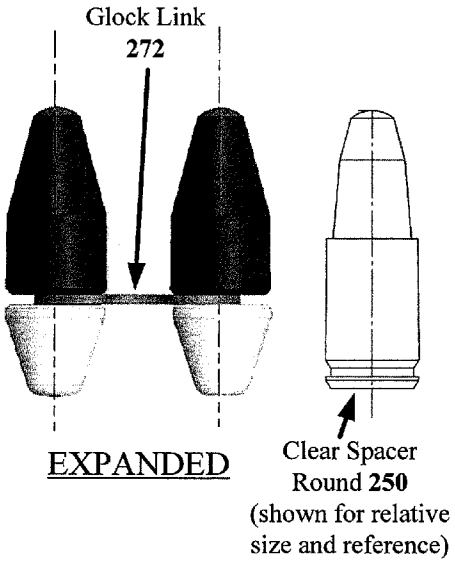

FIG. 31A and FIG. 31B show different isolated views of the Glock Link 272. FIGS. 31C and 31D show the Glock last round linked assembly 210 in its contracted and expanded configurations, respectively, movement between said two being provided by the Glock Link 272.

Operational Differences Between Glock and Previously-Described Other Configurations In the standard operation of the referenced "other" double stacked magazines, the last round link comes up to the top of the clip pushing the last live round. After that round is chambered and fired, the last link assembly comes up to the top of the clip. The bolt of the "other" weapon comes forward over the tapered end of the assembly, sliding over it. The bolt does not chamber this round. The top round of the assembly is held in place by being linked to the round immediately below it. The bolt closes on an empty chamber and stops.

In the operation of the Glock last round linked assembly 270 according to one of the present inventions, the link assembly 270 comes up to a position slightly below the top of the clip. It pushes the last live round up just high enough to be struck and chambered by the Glock weapon bolt. The special inert "spreader" round 250 and the ability of the two linked rounds to spread apart allows the Glock last round link assembly 270 to compress into the narrower channel caused by the taper of the Glock clip and push the last live round up to be chambered. When being so laterally "compressed" due to the narrowing passageway, in on embodiment of one invention the spreadable link 272 actually comes in contact with the largest diameter of the special inert "spreader" round 250. The Glock last round link assembly 270 does not go completely to the top of the clip. After firing the last live round, the bolt comes forward over the tapered end of the assembly, closes on an empty chamber and stops.

Note that when the associated double drum assembly 9 is fully loaded the special inert "spreader" round 250 goes into one drum, and the two linked dummy cartridges 274 in the Glock last round link assembly 270 go in the other drum. The two linked dummy cartridges 274 only come in contact with the inert "spreader" round 250 once in the feed clip assembly 210.

Just as in the straight Glock magazines, to load the current device a Glock loader pushes the top round down, then the next round to be loaded is pushed in (not down) by hand from the front of the clip into the space vacated.

.338 Cartridge Version

Figure 32:
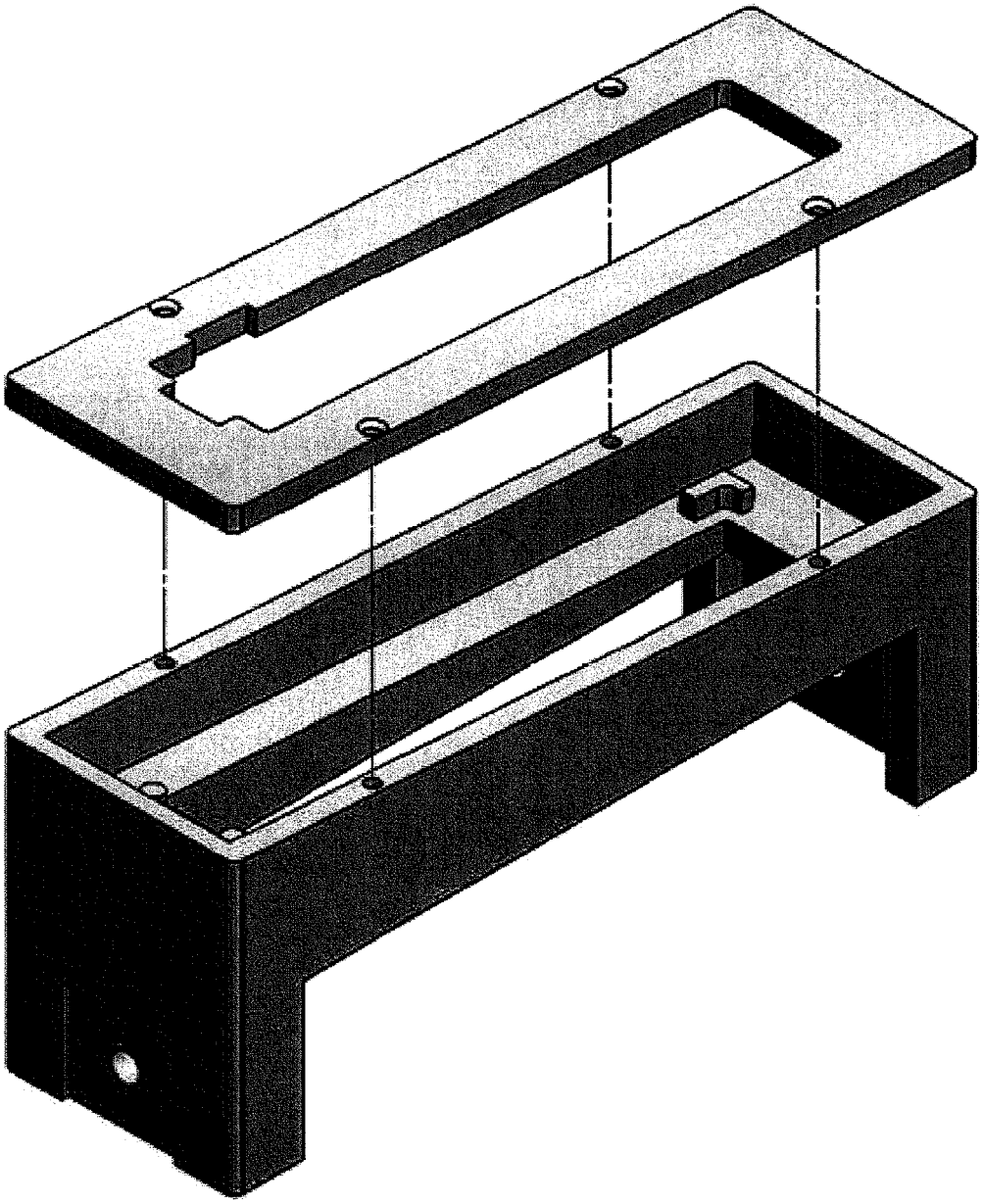
FIG. 32 shows a magazine adaptor for a custom made single drum magazine for the .338 cartridge.

FIG. 32 shows a magazine adaptor for a custom made single drum magazine for the .338 cartridge. This adaptor is made of steel. Note that it does not include engagement holes.

Variations

Note that although some calibers are mentioned, the list is not exhaustive or limiting. Calibers including 5.56 mm, 6.8 SPC, 7.62×39 etc. are all intended to be covered herein.

V. CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A last linked assembly and clear spacer cartridge combination for use with a firearm using a firearm having a magazine well, and for use with a multi-cartridge ammunition magazine housing having an ammunition outlet, and for use with a feed clip assembly having a double stack portion tapering to a single stack exit location, said last linked assembly and clear spacer cartridge combination comprising the following components:

A) a first dummy cartridge;

B) a second dummy cartridge;

C) a "loose" link for holding said first and second dummy cartridges together, said first and second dummy cartridges and said link comprising said last linked assembly; and D) a "spreader" spacer cartridge configured to move along with said first and second dummy cartridges in a double stacked configuration as said spacer cartridge and said first and second dummy cartridges pass together through said double stack portion of said feed clip assembly, said spacer cartridge also configured to spread apart said first and second dummy cartridges within the tolerances of said "loose" link, to allow the last linked assembly to compress into the narrower channel caused by the taper of the feed clip assembly and push the last live round up to be chambered.

2. The last linked assembly as claimed in claim 1, wherein said clear spacer cartridge comprises said "spreader" spacer cartridge.

3. A last linked assembly and clear spacer cartridge combination for use with a firearm using a firearm having a magazine well, and for use with a multi-cartridge ammunition magazine housing having an ammunition outlet for dispensing at least one live ammunition cartridge, and for use with a feed clip assembly having a double stack passageway portion tapering to a single stack exit location, said feed clip assembly configured to provide a passageway from said multi-cartridge ammunition magazine housing to said firearm proximate said magazine well, said last linked assembly and clear spacer cartridge combination comprising the following components:

A) a leading linked dummy cartridge;

B) a trailing linked dummy cartridge;

C) a spreadable link for linking said leading and trailing linked dummy cartridges together while allowing them freedom to move between a more spaced apart relationship and a less spaced apart relationship, said leading and trailing linked dummy cartridges and said link comprising a last linked assembly; and D) a spacer cartridge configured to move along with leading and trailing linked dummy cartridges in a double stacked configuration as said spacer cartridge and said first and second dummy cartridges pass together through said double stack passageway portion of said feed clip assembly while said leading and trailing linked dummy cartridges are in one side of the double stack and said spacer cartridge is on the other side of the double stack, said spacer cartridge also configured to bias against said first and second dummy cartridges and spread them apart from their less spaced apart relationship position to their more spaced apart relationship as they approach said single stack exit location, to allow said leading linked dummy cartridge to push said at least one live ammunition cartridge out of said single stack exit location.

4. The last linked assembly as claimed in claim 3, wherein said leading and trailing dummy cartridges are linked together by said loose link, and wherein said spacer cartridge is not linked to either of said leading and trailing dummy cartridges, and wherein said leading and trailing dummy cartridges and said spacer cartridge are all inert.

5. The last linked assembly as claimed in claim 4, wherein said linked leading and trailing dummy cartridges are each tapered front and rear and each includes a center portion having a reduced diameter, and wherein said loose link defines two openings, each opening configured to loosely fit around a center portion of a corresponding one of said leading and trailing dummy cartridges.

6. The last linked assembly as claimed in claim 5, wherein said link allows said linked dummy rounds to move apart by approximately half their diameters.

7. A combination of feed elements for use with a firearm using a firearm having a magazine well, and for use with a multi-cartridge ammunition magazine housing having an ammunition outlet for dispensing at least one live ammunition cartridge, and for use with a feed clip assembly having a double stack passageway portion and a tapering portion tapering to a single stack exit location, said feed clip assembly configured to provide a passageway from said multi-cartridge ammunition magazine housing to said firearm proximate said magazine well, said combination of feed elements comprising the following components:

A) a leading linked dummy cartridge;

B) a trailing linked dummy cartridge;

C) a spreadable link for linking said leading and trailing linked dummy cartridges together while allowing them freedom to move between a more spaced apart relationship and a less spaced apart relationship, said leading and trailing linked dummy cartridges and said link comprising a last linked assembly; and D) a spacer cartridge configured to move along with leading and trailing linked dummy cartridges in a double stacked configuration as said spacer cartridge and said first and second dummy cartridges pass together through said double stack passageway portion of said feed clip assembly while said leading and trailing linked dummy cartridges are in one side of the double stack and said spacer cartridge is on the other side of the double stack, said spacer cartridge also configured to bias against said first and second dummy cartridges and spread them apart from their less spaced apart relationship position to their more spaced apart relationship as they pass through said tapering portion of said feed clip assembly and approach said single stack exit location, to allow said leading linked dummy cartridge to push said at least one live ammunition cartridge out of said single stack exit location.

8. The last linked assembly as claimed in claim 7, further comprising a loose inert cartridge being separate from said first and second dummy cartridges and positioned in said other side of the double stack and trailing said spacer cartridge, said loose inert cartridge configured to bias at least partially against said spacer cartridge as said spacer cartridge moves along with leading and trailing linked dummy cartridges.

9. The last linked assembly as claimed in claim 8, wherein said loose inert cartridge is a first inert dummy cartridge, and further comprising a second inert dummy cartridge being separate from said first and second dummy cartridges and trailing said trailing linked dummy cartridge, said second inert dummy cartridge configured to bias at least partially against said trailing linked dummy cartridge as said spacer cartridge moves along with leading and trailing linked dummy cartridges.

10. The last linked assembly and clear spacer cartridge combination as claimed in claim 7, wherein said combination can be used with at least one feed drum.

11. A method of dispensing live ammunition from a multi-cartridge ammunition magazine housing having an ammunition outlet to a firearm having a magazine well, said method including the following steps A) providing the following:

1) a firearm with a magazine well;

2) a multi-cartridge ammunition magazine housing having an ammunition outlet;

3) a feed clip assembly having a double stack passageway portion as well as a tapering portion tapering to a single stack exit location, said feed clip assembly configured to fit in the well;

4) a leading linked dummy cartridge;

5) a trailing linked dummy cartridge;

6) a spreadable link for linking said leading and trailing linked dummy cartridges together while allowing them freedom to move between a more spaced apart relationship and a less spaced apart relationship, said leading and trailing linked dummy cartridges and said link comprising a last linked assembly; and 7) a spacer cartridge configured to move along with leading and trailing linked dummy cartridges in a double stacked configuration as said spacer cartridge and said first and second dummy cartridges pass together through said double stack passageway portion of said feed clip assembly while said leading and trailing linked dummy cartridges are in one side of the double stack and said spacer cartridge is on the other side of the double stack, said spacer cartridge also configured to bias against said first and second dummy cartridges and spread them apart from their less spaced apart relationship position to their more spaced apart relationship as they approach said single stack exit location, to allow said leading linked dummy cartridge to push said at least one live ammunition cartridge out of said single stack exit location;

B) urging said last linked assembly and said spacer cartridge through said double stack passageway portion of said feed clip assembly while said leading and trailing linked dummy cartridges are in one side of the double stack and said spacer cartridge is on the other side of the double stack; and C) urging said last linked assembly and said spacer cartridge through said tapering portion of said feed clip assembly such that said spacer cartridge biases against said first and second dummy cartridges and spreads them apart from their less spaced apart relationship position to their more spaced apart relationship as they approach said single stack exit location, and such that said leading linked dummy cartridge pushes said at least one live ammunition cartridge out of said single stack exit location.

* * * * *